US011304454B1

(12) United States Patent
Fujinaga et al.

(10) Patent No.: US 11,304,454 B1
(45) Date of Patent: Apr. 19, 2022

(54) POWER SUPPLY UNIT FOR AEROSOL GENERATION DEVICE, AND AEROSOL GENERATION DEVICE

(71) Applicant: Japan Tobacco Inc., Tokyo (JP)

(72) Inventors: Ikuo Fujinaga, Tokyo (JP); Takuma Nakano, Tokyo (JP); Hajime Fujita, Tokyo (JP); Yutaka Kaihatsu, Tokyo (JP); Mai Sugiura, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 0 days.

(21) Appl. No.: 17/489,815

(22) Filed: Sep. 30, 2021

(30) Foreign Application Priority Data

Sep. 30, 2020 (JP) ..... JP2020-166304

(51) Int. Cl.

| | |
|---|---|
| ***A24F 13/00*** | (2006.01) |
| ***A24F 40/53*** | (2020.01) |
| ***A24F 40/30*** | (2020.01) |
| ***A24F 40/20*** | (2020.01) |
| ***A24F 40/46*** | (2020.01) |
| ***A24F 40/10*** | (2020.01) |
| ***A24F 40/57*** | (2020.01) |

(52) U.S. Cl.
CPC ..... *A24F 40/53* (2020.01); *A24F 40/10* (2020.01); *A24F 40/20* (2020.01); *A24F 40/30* (2020.01); *A24F 40/46* (2020.01); *A24F 40/57* (2020.01)

(58) Field of Classification Search
CPC ..... A24F 47/00
USPC ..... 131/328–329
See application file for complete search history.

(56) References Cited

U.S. PATENT DOCUMENTS

2013/0319440 A1 12/2013 Capuano
2017/0071251 A1 3/2017 Goch
(Continued)

FOREIGN PATENT DOCUMENTS

EP 3491945 A1 6/2019
JP 3072384 U 10/2000
(Continued)

OTHER PUBLICATIONS

Notice of Reasons for Refusal dated Jan. 12, 2021, received for JP Application 2020-166304, 6 pages including English Translation.
(Continued)

*Primary Examiner* — Phuong K Dinh
(74) *Attorney, Agent, or Firm* — Xsensus LLP

(57) ABSTRACT

A power supply unit for an aerosol generation device includes: a power supply; a first connector connectable to an atomizer for atomizing an aerosol source; a second connector connectable to a heater for heating a flavor source; and a processing device configured to acquire a temperature of the flavor source or the heater. The processing device is configured to start second discharge from the power supply to the heater to make the temperature of the flavor source or the heater converge to a target temperature, before starting first discharge from the power supply to the atomizer, acquire an elapsed time between a start time point of current second discharge and an end time point of a later one of previous first discharge and previous second discharge, and increase power in the first discharge more and/or decrease the target temperature more as the elapsed time becomes longer.

10 Claims, 14 Drawing Sheets

(56) References Cited

U.S. PATENT DOCUMENTS

| | | | | |
|---|---|---|---|---|
| 2019/0216136 | A1 | 7/2019 | Capuano | |
| 2020/0154766 | A1 | 5/2020 | Jeong | |
| 2020/0260793 | A1 | 8/2020 | Yamada et al. | |
| 2020/0352246 | A1* | 11/2020 | Yamada | A24F 40/51 |
| 2021/0169148 | A1 | 6/2021 | Nakano et al. | |
| 2021/0195961 | A1 | 7/2021 | Marubashi et al. | |

FOREIGN PATENT DOCUMENTS

| | | | |
|---|---|---|---|
| JP | 2010-213579 | A | 9/2010 |
| JP | 6030580 | B2 | 11/2016 |
| JP | 2017-511703 | A | 4/2017 |
| WO | 2019/017654 | A2 | 1/2019 |
| WO | 2019/082264 | A1 | 5/2019 |
| WO | 2020/039589 | A1 | 2/2020 |
| WO | 2020/059049 | A1 | 3/2020 |
| WO | 2020/084779 | A1 | 4/2020 |

OTHER PUBLICATIONS

Decision to Grant dated Mar. 2, 2021, received for JP Application 2020-166304, 5 pages including English Translation.
European search report dated Feb. 9, 2022, in corresponding European patent Application No. 21199813.3, 4 pages.
Office Action dated Feb. 21, 2022, in corresponding European patent Application No. 21199813.3, 7 pages.

* cited by examiner

POWER SUPPLY UNIT FOR AEROSOL GENERATION DEVICE, AND AEROSOL GENERATION DEVICE

CROSS-REFERENCE TO RELATED APPLICATION

This application claims priority to Japanese Patent Application No. 2020-166304 filed on Sep. 30, 2020, the content of which is incorporated herein by reference.

TECHNICAL FIELD

The present invention relates to a power supply unit for an aerosol generation device, and an aerosol generation device.

BACKGROUND ART

JP 6030580 B discloses an electronic cigarette including a heating element, a power supply configured to supply power having a certain voltage to the heating element, a sensor configured to detect an air flow of an inhaling operation, and a processor configured to control the power supply based on an interval of the inhaling operation.

WO 2020/039589, JP 2017-511703 T, and WO 2019/017654 disclose devices that can add a flavor to an aerosol by allowing the aerosol generated by heating a liquid to pass through a flavor source, and allow a user to inhale the aerosol to which the flavor is added.

In order to enhance a commercial value of an aerosol generation device that can generate the aerosol and let the aerosol to be inhaled, it is important for the aerosol generation device to provide a user with an aerosol having a stable flavor for each inhaling.

An object of the present invention is to increase a commercial value of an aerosol generation device.

SUMMARY OF INVENTION

A power supply unit of an aerosol generation device according to an aspect of the present invention includes: a power supply; a first connector electrically connectable to an atomizer capable of atomizing an aerosol source and electrically connected to the power supply; a second connector connectable to a heater capable of heating a flavor source that adds a flavor to an aerosol generated from the aerosol source, and electrically connected to the power supply; and a processing device configured to acquire a temperature of the flavor source or the heater. The processing device is configured to start second discharge, which is discharge from the power supply to the heater to make the temperature of the flavor source or the heater converge to a target temperature, before starting first discharge, which is discharge from the power supply to the atomizer. The processing device is configured to acquire an elapsed time between a start time point of current second discharge and an end time point of a later one of previous first discharge and previous second discharge. The processing device is configured to increase power in the first discharge more and/or decrease the target temperature more as the elapsed time becomes longer.

BRIEF DESCRIPTION OF DRAWINGS

FIG. 7 is a flow chart for explaining an operation of the aerosol generation device in

FIG. 1.

FIG. 8 is a flow chart for explaining the operation of the aerosol generation device in

FIG. 1.

DESCRIPTION OF EMBODIMENTS

Hereinafter, an aerosol generation device 1, which is an embodiment of an aerosol generation device according to the present invention, will be described with reference to FIGS. 1 to 6.

(Aerosol Generation Device)

Figure 1:
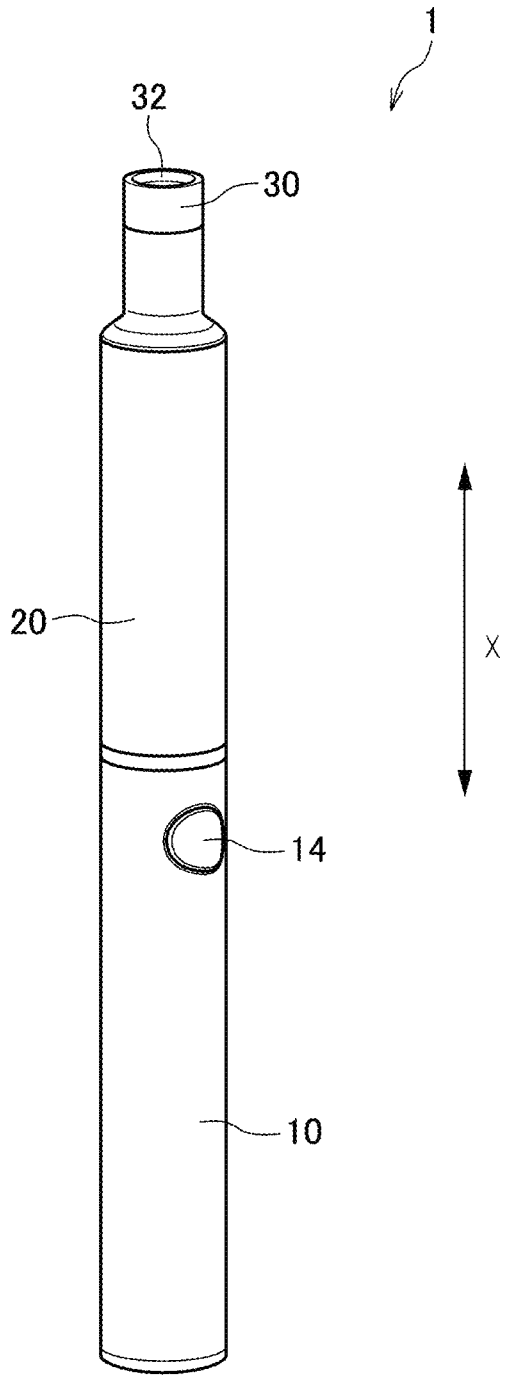
FIG. 1 is a perspective view schematically showing a schematic configuration of an aerosol generation device.
Figure 2:
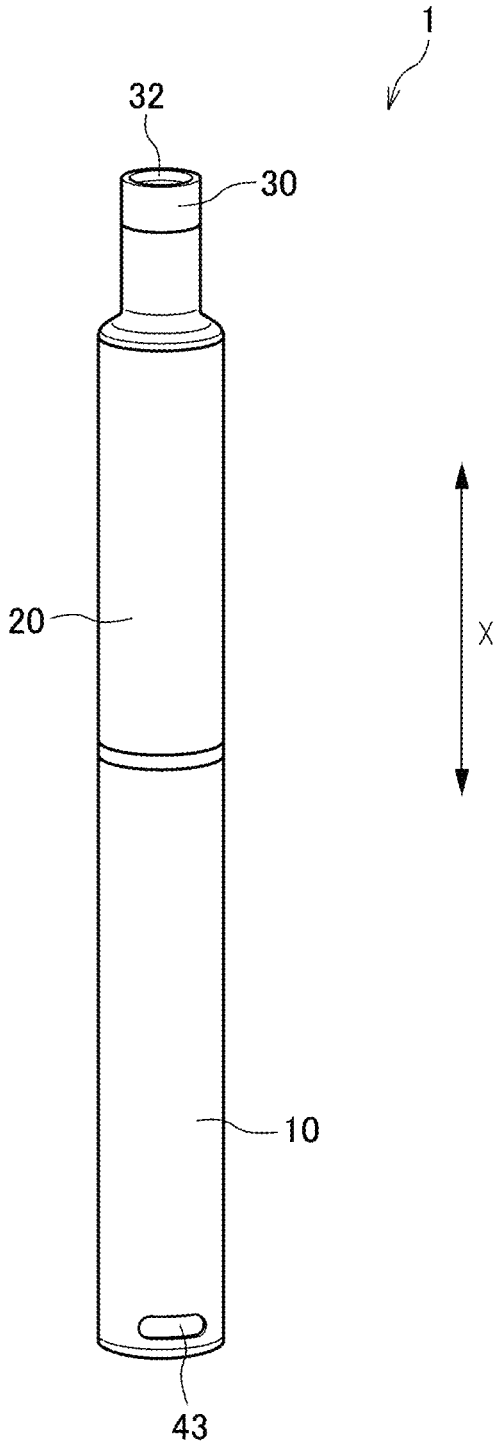
FIG. 2 is another perspective view of the aerosol generation device in FIG. 1.
Figure 3:
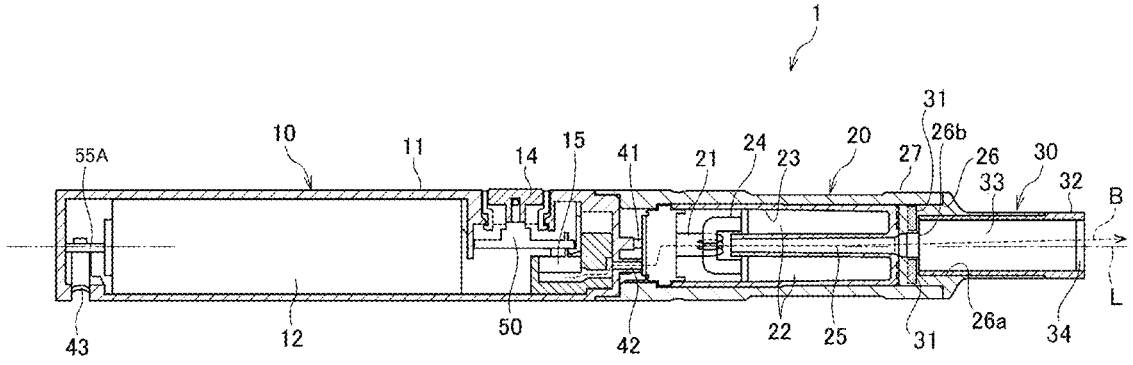
FIG. 3 is a cross-sectional view of the aerosol generation device in FIG. 1.

The aerosol generation device 1 is an instrument that generates an aerosol to which a flavor component is added without burning and lets the aerosol to be inhaled, and has a rod shape that extends along a predetermined direction (hereinafter, referred to as a longitudinal direction X) as shown in FIGS. 1 and 2. In the aerosol generation device 1, a power supply unit 10, a first cartridge 20 and a second cartridge 30 are provided in this order along the longitudinal direction X. The first cartridge 20 is attachable to and detachable from (in other words, replaceable with respect to) the power supply unit 10. The second cartridge 30 is attachable to and detachable from (in other words, replaceable with respect to) the first cartridge 20. As shown in FIG. 3, the first cartridge 20 is provided with a first load 21 and a second load 31. An overall shape of the aerosol generation device 1 is not limited to a shape in which the power supply unit 10, the first cartridge 20 and the second cartridge 30 are arranged in a line as shown in FIG. 1. Any shape such as a substantially box shape can be adopted as long as the first cartridge 20 and the second cartridge 30 are configured to be replaceable with respect to the power supply unit 10. The second cartridge 30 may be attachable to and detachable from (in other words, replaceable with respect to) the power supply unit 10.

(Power Supply Unit)

Figure 4:
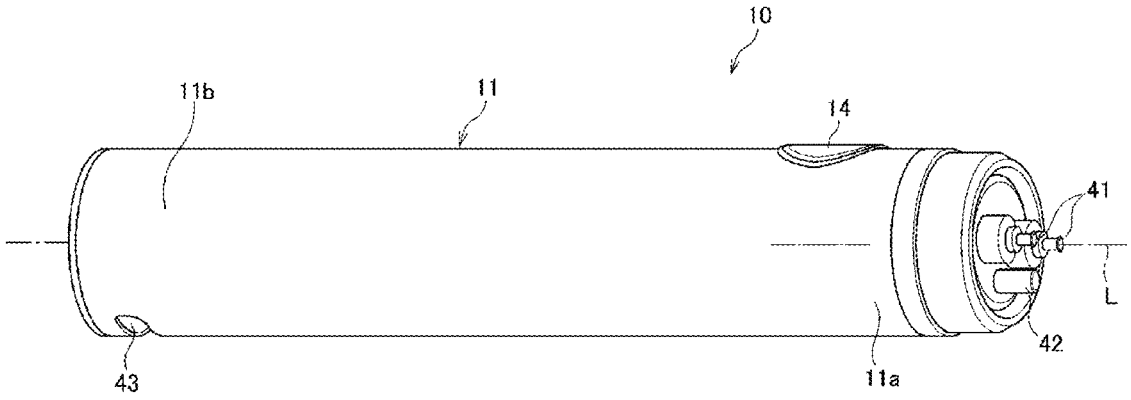
FIG. 4 is a perspective view of a power supply unit in the aerosol generation device in FIG. 1.
Figure 5:
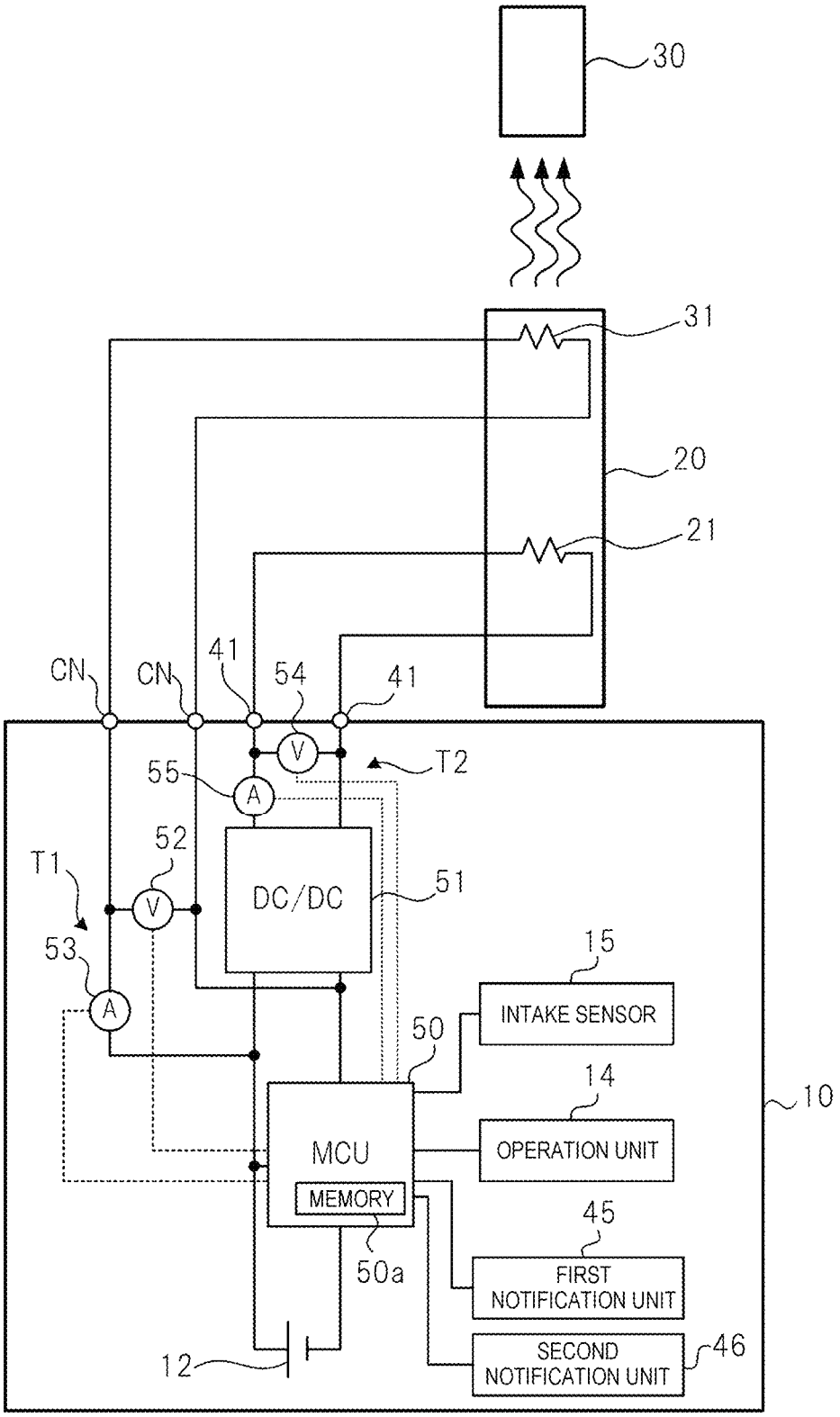
FIG. 5 is a schematic view showing a hardware configuration of the aerosol generation device in FIG. 1.

As shown in FIGS. 3, 4 and 5, the power supply unit 10 accommodates, in a cylindrical power supply unit case 11, a power supply 12, a charging IC 55A, a micro controller unit (MCU) 50, a DC/DC converter 51, an intake sensor 15, a temperature detection element T1 including a voltage sensor 52 and a current sensor 53, a temperature detection element T2 including a voltage sensor 54 and a current sensor 55, a first notification unit 45, and a second notification unit 46.

The power supply 12 is a rechargeable secondary battery, an electric double layer capacitor or the like, and is preferably a lithium ion secondary battery. An electrolyte of the power supply 12 may be constituted by one of a gel-like electrolyte, an electrolytic solution, a solid electrolyte, an ionic liquid, or a combination thereof.

As shown in FIG. 5, the MCU 50 is connected to various sensor devices such as the intake sensor 15, the voltage sensor 52, the current sensor 53, the voltage sensor 54 and the current sensor 55, the DC/DC converter 51, an operation unit 14, the first notification unit 45, and the second notification unit 46, and performs various types of control of the aerosol generation device 1.

Specifically, the MCU 50 mainly includes a processor, and further includes a memory 50*a* formed of a storage medium such as a random access memory (RAM) required for an operation of the processor and a read only memory (ROM) that stores various types of information. Specifically, the processor in the present specification is an electric circuit in which circuit elements such as semiconductor elements are combined.

As shown in FIG. 4, a discharging terminal 41 constituting a first connector are provided on a top portion 11*a* positioned on one end side of the power supply unit case 11 in the longitudinal direction X (a first cartridge 20 side). The discharging terminal 41 is provided so as to protrude from an upper surface of the top portion 11*a* toward the first cartridge 20, and can be electrically connected to each of the first load 21 and the second load 31 of the first cartridge 20. Although not shown in FIG. 4, the top portion 11*a* is provided with a connector CN constituting a second connector (see FIGS. 5 and 6). The discharging terminal 41 is electrically connected to the power supply 12. The discharging terminal 41 is electrically connected to the first load 21 in a state where the first cartridge 20 is attached to the power supply unit 10. The connector CN is electrically connected to the power supply 12. The connector CN is electrically connected to the second load 31 in a state where the first cartridge 20 is attached to the power supply unit 10. In the aerosol generation device 1 shown in FIGS. 4 to 6, the first load 21 and the second load 31 are provided in the first cartridge 20. Alternatively, the second load 31 may be provided in the second cartridge 30, and the first load 21 and the second load 31 may be provided in the power supply unit 10. In either case, the discharging terminal 41 constituting the first connector and the connector CN constituting the second connector are provided in the power supply unit 10.

On the upper surface of the top portion 11*a*, an air supply unit 42 that supplies air to the first load 21 of the first cartridge 20 is provided in vicinity of the discharging terminal 41.

A charging terminal 43 that can be electrically connected to an external power supply (not shown) is provided in a bottom portion 11*b* positioned on the other end side of the power supply unit case 11 in the longitudinal direction X (a side opposite to the first cartridge 20). The charging terminal 43 is provided in a side surface of the bottom portion 11*b*, and can be connected to, for example, a universal serial bus (USB) terminal, a microUSB terminal or the like.

The charging terminal 43 may be a power reception unit that can receive power transmitted from the external power supply in a wireless manner. In such a case, the charging terminal 43 (the power reception unit) may be formed of a power reception coil. A wireless power transfer method may be an electromagnetic induction type, a magnetic resonance type, or a combination of the electromagnetic induction type and the magnetic resonance type. The charging terminal 43 may be a power reception unit that can receive power transmitted from the external power supply in a contactless manner. As another example, the charging terminal 43 can be connected to a USB terminal or a micro USB terminal, and may include the power reception unit described above.

The power supply unit case 11 is provided with the operation unit 14 that can be operated by a user in a side surface of the top portion 11*a* so as to face a side opposite to the charging terminal 43. More specifically, the operation unit 14 and the charging terminal 43 have a point-symmetrical relationship with respect to an intersection between a straight line connecting the operation unit 14 and the charging terminal 43 and a center line of the power supply unit 10 in the longitudinal direction X. The operation unit 14 includes a button-type switch, a touch panel or the like. When a predetermined activation operation is performed by the operation unit 14 in a state where the power supply unit 10 is in a power-off state, the operation unit 14 outputs an activation command of the power supply unit 10 to the MCU 50.

The power supply unit 10 is operable in a sleep mode in which power consumption is minimized and in an operation mode in which power consumption is larger than that in the sleep mode. When the MCU 50 acquires the activation command in the sleep mode, the MCU 50 returns the power supply unit 10 from the sleep mode to the operation mode.

As shown in FIG. 3, the intake sensor 15 that detects a puff (inhaling) operation is provided in vicinity of the operation unit 14. The power supply unit case 11 is provided with an air intake port (not shown) that takes outside air into the power supply unit case 11. The air intake port may be provided around the operation unit 14 or may be provided around the charging terminal 43.

The intake sensor 15 is configured to output a value of a change in pressure (internal pressure) in the power supply unit 10 due to inhaling of the user through an inhale port 32 described later. The intake sensor 15 is, for example, a pressure sensor that outputs an output value (for example, a voltage value or a current value) corresponding to the internal pressure that changes according to a flow rate of air inhaled from the air intake port toward the inhale port 32 (that is, the puff operation of the user). The intake sensor 15 may output an analog value, or may output a digital value converted from the analog value.

In order to compensate for a pressure to be detected, the intake sensor 15 may include a temperature sensor that detects a temperature of an environment where the power supply unit 10 is placed (an outside air temperature). The intake sensor 15 may include a condenser microphone or the like instead of the pressure sensor.

When the puff operation is performed and the output value of the intake sensor 15 is equal to or greater than an output threshold value, the MCU 50 determines that an aerosol generation request (an atomization command of an aerosol source 22 described later) is made, and thereafter, when the output value of the intake sensor 15 falls below the output threshold value, the MCU 50 determines that the aerosol generation request ends. In the aerosol generation device 1, for a purpose of preventing overheating of the first load 21 or the like, when a period during which the aerosol generation request is made reaches an upper limit time $t_{upper}$ (for example, 2.4 seconds), it is determined that the aerosol generation request ends regardless of the output value of the intake sensor 15.

Instead of the intake sensor 15, the aerosol generation request may be detected based on an operation of the operation unit 14. For example, when the user performs a predetermined operation on the operation unit 14 in order to start inhaling of an aerosol, the operation unit 14 may output a signal indicating the aerosol generation request to the MCU 50.

The charging IC 55A is disposed close to the charging terminal 43, and controls charging of power input from the charging terminal 43 to the power supply 12. The charging IC 55A may be disposed in vicinity of the MCU 50.

(First Cartridge)

As shown in FIG. 3, the first cartridge 20 includes, inside a cylindrical cartridge case 27, a reservoir 23 constituting a storage portion that stores the aerosol source 22, the first load 21 constituting an atomizer that atomizes the aerosol source 22 to generate the aerosol, a wick 24 that draws the aerosol source 22 from the reservoir 23 to a position of the first load 21, an aerosol flow path 25 constituting a cooling passage that sets a particle size of the aerosol generated by atomization of the aerosol source 22 to a size suitable for inhaling, an end cap 26 that accommodates a part of the second cartridge 30, and the second load 31 provided on the end cap 26 for heating the second cartridge 30.

The reservoir 23 is partitioned and formed so as to surround a periphery of the aerosol flow path 25, and stores the aerosol source 22. A porous body such as a resin web or cotton may be accommodated in the reservoir 23, and the aerosol source 22 may be impregnated in the porous body. The reservoir 23 may only store the aerosol source 22 without accommodating the porous body such as the resin web or cotton. The aerosol source 22 contains a liquid such as glycerin, propylene glycol or water.

The wick 24 is a liquid holding member that draws the aerosol source 22 from the reservoir 23 to the position of the first load 21 by using a capillary phenomenon. The wick 24 constitutes a holding portion that holds the aerosol source 22 supplied from the reservoir 23 at the position where the aerosol source 22 can be atomized by the first load 21. The wick 24 is made of, for example, glass fiber or porous ceramic.

The aerosol source 22 included in the first cartridge 20 is held by each of the reservoir 23 and the wick 24, but in the following, a reservoir remaining amount $W_{reservoir}$, which is a remaining amount of the aerosol source 22 stored in the reservoir 23, is treated as the remaining amount of the aerosol source 22 included in the first cartridge 20. The reservoir remaining amount $W_{reservoir}$ is 100% when the first cartridge 20 is new, and decreases as the aerosol is generated (the aerosol source 22 is atomized). The reservoir remaining amount $W_{reservoir}$ is calculated by the MCU 50 and stored in the memory 50*a* of the MCU 50. Hereinafter, the reservoir remaining amount $W_{reservoir}$ may be simply referred to as a reservoir remaining amount.

The first load 21 heats the aerosol source 22 by power supplied from the power supply 12 via the discharging terminal 41 without burning, thereby atomizing the aerosol source 22. In principle, as the power supplied from the power supply 12 to the first load 21 increases, an amount of the aerosol source to be atomized increases. The first load 21 is formed of an electric heating wire (a coil) wound at a predetermined pitch.

The first load 21 may be any element that can atomize the aerosol source 22 to generate the aerosol by heating the aerosol source 22. The first load 21 is, for example, a heat generation element. Examples of the heat generation element include a heat generation resistor, a ceramic heater and an induction heating type heater.

The first load 21 has a correlation between temperature and electric resistance. As the first load 21, for example, a load having positive temperature coefficient (PTC) characteristics in which an electric resistance value increases as a temperature increases is used.

The aerosol flow path 25 is provided on a center line L of the power supply unit 10 on a downstream side of the first load 21. The end cap 26 includes a cartridge accommodating portion 26*a* that accommodates a part of the second cartridge 30, and a communication path 26*b* that allows the aerosol flow path 25 and the cartridge accommodating portion 26*a* to communicate with each other.

The second load 31 is embedded in the cartridge accommodating portion 26*a*. The second load 31 heats the second cartridge 30 (more specifically, a flavor source 33 included in the second cartridge 30) accommodated in the cartridge accommodating portion 26*a* by the power supplied from the power supply 12 via the discharging terminal 41. The second load 31 is formed of, for example, an electric heating wire (a coil) wound at a predetermined pitch.

The second load 31 may be any element that can heat the second cartridge 30. The second load 31 is, for example, a heat generation element. Examples of the heat generation element include a heat generation resistor, a ceramic heater and an induction heating type heater.

The second load 31 has a correlation between temperature and electric resistance. As the second load 31, for example, a load having the PTC characteristics is used.

(Second Cartridge)

The second cartridge 30 stores the flavor source 33. When the second cartridge 30 is heated by the second load 31, the flavor source 33 is heated. The second cartridge 30 is detachably accommodated in the cartridge accommodating portion 26*a* provided in the end cap 26 of the first cartridge 20. In the second cartridge 30, an end portion on a side opposite to the first cartridge 20 side serves as the inhale port 32 of the user. The inhale port 32 is not limited to a case where the inhale port 32 is integrally formed with the second cartridge 30, and may be configured to be detachable from the second cartridge 30. The inhale port 32 can be kept hygienic by configuring the inhale port 32 separately from the power supply unit 10 and the first cartridge 20 in this way. A filter 34 made of fiber such as acetate is accommodated inside the inhale port 32. Charcoal may be added to the filter 34.

$$W_{flavor} = \beta \times \{W_{capsule}(n_{puff}) \times T_{capsule}\} \times \gamma \times W_{aerosol} \tag{2}$$

$$W_{capsule}(n_{puff}) = W_{initial} - \delta \cdot \sum_{i=1}^{n_{puff}} W_{flavor}(i) \tag{3}$$

The second cartridge 30 adds a flavor component to the aerosol by allowing the aerosol generated by atomization of the aerosol source 22 by the first load 21 to pass through the flavor source 33. As a raw material piece constituting the flavor source 33, it is possible to use chopped tobacco or a molded body obtained by molding a tobacco raw material into a granular shape. The flavor source 33 may be formed of a plant other than tobacco (for example, mint, Chinese herb or herb). A fragrance such as menthol may be added to the flavor source 33.

In the aerosol generation device 1, the aerosol source 22 and the flavor source 33 can generate the aerosol to which the flavor component is added. That is, the aerosol source 22 and the flavor source 33 constitute an aerosol generation source that generates the aerosol.

The aerosol generation source in the aerosol generation device 1 is a portion that is replaced and used by the user. The portion is provided to the user, for example, as a set of one first cartridge 20 and one or more (for example, five) second cartridges 30. The first cartridge 20 and the second cartridge 30 may be integrated into one cartridge.

In the aerosol generation device 1 configured in this way, as indicated by an arrow B in FIG. 3, air that flows in from the intake port (not shown) provided in the power supply unit case 11 passes through vicinity of the first load 21 of the first cartridge 20 from the air supply unit 42. The first load 21 atomizes the aerosol source 22 drawn from the reservoir 23 by the wick 24. The aerosol generated by atomization flows through the aerosol flow path 25 together with the air that flows in from the intake port, and is supplied to the second cartridge 30 via the communication path 26*b*. The aerosol supplied to the second cartridge 30 passes through the flavor source 33 to be added with the flavor component, and is then supplied to the inhale port 32.

The aerosol generation device 1 is also provided with the first notification unit 45 and the second notification unit 46 that notify the user of various types of information (see FIG. 5). The first notification unit 45 is for performing a notification that acts on tactile sense of the user, and is formed of a vibration element such as a vibrator. The second notification unit 46 is for performing a notification that acts on visual sense of the user, and is formed of a light emitting element such as a light emitting diode (LED). As the notification unit that notifies various types of information, a sound output element may be further provided to perform a notification that acts on auditory sense of the user. The first notification unit 45 and the second notification unit 46 may be provided in any one of the power supply unit 10, the first cartridge 20 and the second cartridge 30, but are preferably provided in the power supply unit 10. For example, a configuration in which a periphery of the operation unit 14 has light-transmissive properties and light is emitted by a light emitting element such as an LED is employed. One of the first notification unit 45 and the second notification unit 46 may be omitted.

(Details of Power Supply Unit)

As shown in FIG. 5, the DC/DC converter 51 is connected between the first load 21 and the power supply 12 in a state where the first cartridge 20 is attached to the power supply unit 10. The MCU 50 is connected between the DC/DC converter 51 and the power supply 12. The second load 31 is connected between the MCU 50 and the DC/DC converter 51 in a state where the first cartridge 20 is attached to the power supply unit 10. In this way, in the power supply unit 10, a series circuit of the DC/DC converter 51 and the first load 21, and the second load 31 are connected in parallel to the power supply 12 in a state where the first cartridge 20 is attached.

The DC/DC converter 51 is a booster circuit that can boost an input voltage, and is configured to supply a voltage obtained by boosting the input voltage or the input voltage to the first load 21. Since the power supplied to the first load 21 can be adjusted by the DC/DC converter 51, an amount of the aerosol source 22 atomized by the first load 21 can be controlled. As the DC/DC converter 51, for example, a switching regulator that converts the input voltage into a desired output voltage by controlling an on/off time of a switching element while monitoring the output voltage can be used. When the switching regulator is used as the DC/DC converter 51, the input voltage can be output directly without being boosted by controlling the switching element.

The processor of the MCU 50 is configured to acquire a temperature of the flavor source 33 and a temperature of the second load 31 in order to control discharge to the second load 31. The processor of the MCU 50 is preferably configured to acquire the temperature of the first load 21. The temperature of the first load 21 can be used to prevent overheating of the first load 21 or the aerosol source 22, and to highly control the amount of the aerosol source 22 atomized by the first load 21.

The voltage sensor 52 measures and outputs a value of a voltage applied to the second load 31. The current sensor 53 measures and outputs a value of a current that flows through the second load 31. An output of the voltage sensor 52 and an output of the current sensor 53 are input to the MCU 50. The processor of the MCU 50 acquires a resistance value of the second load 31 based on the output of the voltage sensor 52 and the output of the current sensor 53, and acquires the temperature of the second load 31 corresponding to the resistance value. The temperature of the second load 31 does not exactly coincide with the temperature of the flavor source 33 heated by the second load 31, but can be regarded as substantially the same as the temperature of the flavor source 33.

If a constant current flows through the second load 31 when the resistance value of the second load 31 is acquired, the current sensor 53 is unnecessary in the temperature detection element T1. Similarly, if a constant voltage is applied to the second load 31 when the resistance value of the second load 31 is acquired, the voltage sensor 52 is unnecessary in the temperature detection element T1.

Figure 6:
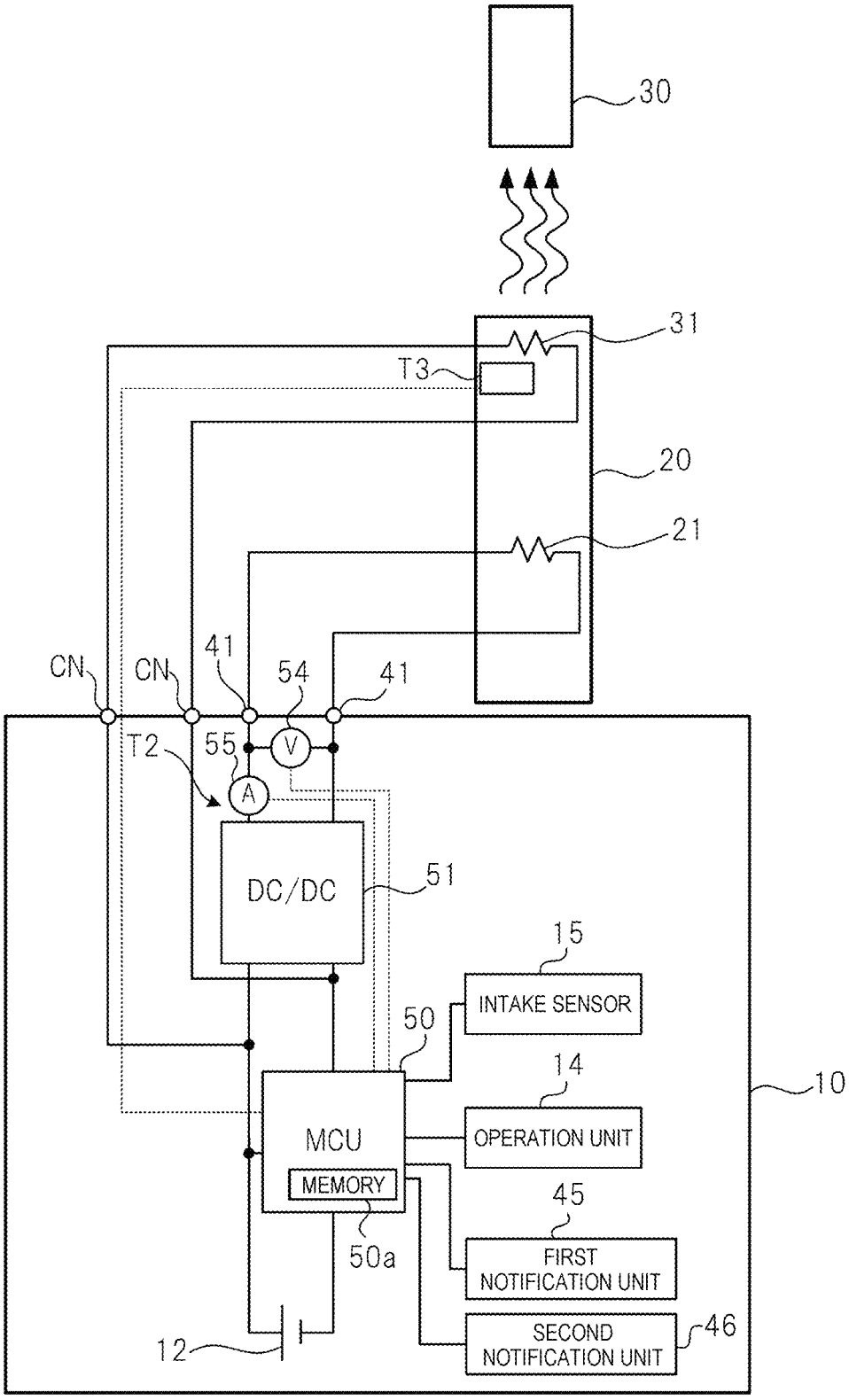
FIG. 6 is a schematic view showing a modification of the hardware configuration of the aerosol generation device in FIG. 1.

As shown in FIG. 6, instead of the temperature detection element T1, a temperature detection element T3 that detects a temperature of the second cartridge 30 or the second load 31 may be provided in the first cartridge 20. The temperature detection element T3 is formed of, for example, a thermistor disposed in vicinity of the second cartridge 30 or the second load 31. In a configuration shown in FIG. 6, the processor of the MCU 50 acquires the temperature of the second load 31 or the temperature of the second cartridge 30, in other words, a temperature of the flavor source 33, based on an output of the temperature detection element T3.

As shown in FIG. 6, by acquiring the temperature of the flavor source 33 using the temperature detection element T3, the temperature of the flavor source 33 can be acquired more accurately than by acquiring the temperature of the flavor source 33 using the temperature detection element T1 in FIG. 5. The temperature detection element T3 may be mounted on the second cartridge 30. According to the configuration shown in FIG. 6 in which the temperature detection element T3 is mounted on the first cartridge 20, a manufacturing cost of the second cartridge 30 having the highest replacement frequency in the aerosol generation device 1 can be reduced.

As shown in FIG. 5, when the temperature of the flavor source 33 is acquired using the temperature detection element T1, the temperature detection element T1 can be provided in the power supply unit 10 having the lowest replacement frequency in the aerosol generation device 1. Therefore, a manufacturing cost of the first cartridge 20 and the second cartridge 30 can be reduced.

The voltage sensor 54 measures and outputs a value of a voltage applied to the first load 21. The current sensor 55 measures and outputs a value of a current that flows through the first load 21. An output of the voltage sensor 54 and an output of the current sensor 55 are input to the MCU 50. The processor of the MCU 50 acquires a resistance value of the first load 21 based on the output of the voltage sensor 54 and the output of the current sensor 55, and acquires the temperature of the first load 21 corresponding to the resistance value. If a constant current flows through the first load 21 when the resistance value of the first load 21 is acquired, the current sensor 55 is unnecessary in the temperature detection element T2.

Similarly, if a constant voltage is applied to the first load 21 when the resistance value of the first load 21 is acquired, the voltage sensor 54 is unnecessary in the temperature detection element T2.

(MCU)

Next, functions of the MCU 50 will be described. The MCU 50 includes a temperature detection unit, a power control unit and a notification control unit as functional blocks realized by the processor executing programs stored in the ROM.

The temperature detection unit acquires the temperature of the flavor source 33 based on an output of the temperature detection element T1 (or the temperature detection element T3). The temperature detection unit acquires the temperature of the first load 21 based on an output of the temperature detection element T2.

The notification control unit controls the first notification unit 45 and the second notification unit 46 to notify various types of information. For example, the notification control unit controls at least one of the first notification unit 45 and the second notification unit 46 to perform a notification for prompting replacement of the second cartridge 30 in response to detection of a replacement timing of the second cartridge 30. The notification control unit is not limited to performing of the notification for prompting the replacement of the second cartridge 30, and may cause a notification for prompting replacement of the first cartridge 20, a notification for prompting replacement of the power supply 12, a notification for prompting charging of the power supply 12, or the like to be performed.

The power control unit controls discharge from the power supply 12 to at least the first load 21 among the first load 21 and the second load 31 (discharge required for heating the load) according to the signal indicating the aerosol generation request output from the intake sensor 15. That is, the power control unit performs at least first discharge among the first discharge from the power supply 12 to the first load 21 for atomizing the aerosol source 22 and second discharge from the power supply 12 to the second load 31 for heating the flavor source 33.

In this way, in the aerosol generation device 1, the flavor source 33 can be heated by the discharge to the second load 31. In order to increase an amount of the flavor component added to the aerosol, it is experimentally known that it is effective to increase an amount of the aerosol generated from the aerosol source 22 and to increase the temperature of the flavor source 33.

Therefore, the power control unit controls the discharge for heating from the power supply 12 to the first load 21 and the second load 31 such that a unit flavor amount (a flavor component amount $W_{flavor}$ described below), which is the amount of the flavor component added to the aerosol generated for each aerosol generation request, converges to a target amount, based on information on the temperature of the flavor source 33. The target amount is a value that is appropriately determined. For example, a target range of the unit flavor amount may be appropriately determined, and a median value in the target range may be determined as the target amount. Accordingly, the unit flavor amount (the flavor component amount $W_{flavor}$) converges to the target amount, whereby the unit flavor amount can converge to the target range having a certain width. Weight may be used as a unit of the unit flavor amount, the flavor component amount $W_{flavor}$, and the target amount.

The power control unit controls the discharge for heating from the power supply 12 to the second load 31 such that the temperature of the flavor source 33 converges to a target temperature (a target temperature $T_{cap_target}$ described below), based on the output of the temperature detection element T1 (or the temperature detection element T3) that outputs the information on the temperature of the flavor source 33.

(Various Parameters Used for Aerosol Generation)

Before proceeding to description of a specific operation of the MCU 50, various parameters and the like used for discharge control for aerosol generation will be described below.

A weight [mg] of the aerosol generated in the first cartridge 20 by one inhaling operation of the user is referred to as an aerosol weight $W_{aerosol}$. The power required to be supplied to the first load 21 for generating the aerosol is referred to as atomization power $P_{liquid}$. Assuming that the aerosol source 22 is sufficiently present, the aerosol weight $W_{aerosol}$ is proportional to the atomization power $P_{liquid}$ and a supply time $t_{sense}$ of the atomization of power $P_{liquid}$ to the first load 21 (in other words, an energization time of the first load 21 or a puff time). Therefore, the aerosol weight $W_{aerosol}$ can be modeled by the following Equation (1). In Equation (1), a is a coefficient obtained experimentally. An upper limit value of the supply time $t_{sense}$ is the above-described upper limit time $t_{upper}$. In addition, the following Equation (1) may be replaced with Equation (1A). In Equation (1A), an intercept b having a positive value is introduced into Equation (1). This is a term that can be freely introduced in consideration of a fact that a part of the atomization power $P_{liquid}$ is used for a rise in the temperature of the aerosol source 22, which occurs before atomization in the aerosol source 22. The intercept b can also be obtained experimentally.

$$W_{aerosol}=a\times P_{liquid}\times t_{sense} \tag{1}$$

$$W_{aerosol}=a\times P_{liquid}\times t_{sense}-b \tag{1A}$$

The weight [mg] of the flavor component contained in the flavor source 33 in a state where the inhaling is performed $n_{puff}$ times ($n_{puff}$ is a natural number of 0 or greater) is described as a flavor component remaining amount $W_{capsule}$ ($n_{puff}$). The flavor component remaining amount ($W_{capsule}$ ($n_{puff}$=0)) contained in the flavor source 33 of the second cartridge 30 in a new product state is also referred to as $W_{initial}$. The information on the temperature of the flavor source 33 is described as a capsule temperature parameter $T_{capsule}$.

The weight [mg] of the flavor component added to the aerosol passing through the flavor source 33 by one inhaling operation of the user is described as a flavor component amount $W_{flavor}$. The information on the temperature of the flavor source 33 is, for example, the temperature of the flavor source 33 or the temperature of the second load 31 acquired based on the output of the temperature detection element T1 (or the temperature detection element T3). Hereinafter, the flavor component remaining amount $W_{capsule}$ ($n_{puff}$) may be simply referred to as the flavor component remaining amount.

It is experimentally known that the flavor component amount $W_{flavor}$ depends on the flavor component remaining amount $W_{capsule}$ ($n_{puff}$), the capsule temperature parameter $T_{capsule}$ and the aerosol weight $W_{aerosol}$. Therefore, the flavor component amount $W_{flavor}$ can be modeled by the following Equation (2).

$$W_{flavor}=\beta\times\{W_{capsule}(n_{puff})\times T_{capsule}\}\times\gamma\times W_{aerosol} \quad (2)$$

Each time the inhaling is performed, the flavor component remaining amount $W_{capsule}$ ($n_{puff}$) decreases by the flavor component amount $W_{flavor}$. Therefore, the flavor component remaining amount $W_{capsule}$ ($n_{puff}$) when $n_{puff}$ is 1 or greater, that is, the flavor component remaining amount after one or more times of inhaling can be modeled by the following Equation (3).

$$W_{capsule}(n_{puff}) = W_{initial} - \delta \cdot \sum_{i=1}^{n_{puff}} W_{flavor}(i) \quad (3)$$

β in Equation (2) is a coefficient indicating a ratio of how much of the flavor component contained in the flavor source 33 is added to the aerosol in one time of inhaling, and is experimentally obtained. γ in Equation (2) and δ in Equation (3) are experimentally obtained coefficients. While the capsule temperature parameter $T_{capsule}$ and the flavor component remaining amount $W_{capsule}$ ($n_{puff}$) may vary during one time of inhaling, γ and δ are introduced in this model in order to handle these as constant values.

(Operation of Aerosol Generation Device)

A general flow of an operation of the aerosol generation device 1 is as follows. When the aerosol generation device 1 is activated by an operation of the operation unit 14 or the like, a target temperature of the flavor source 33 is set. Then, control on discharge to the second load 31 (second discharge) is performed such that a temperature of the flavor source 33 or a temperature of the second load 31 converges to the target temperature, and heating (preheating) of the flavor source 33 is started. When the target temperature is set, atomization power required to be supplied to the first load 21 in order to achieve the target flavor component amount $W_{flavor}$ is determined based on the target temperature and the flavor component remaining amount at that time point. When an aerosol generation request is made after a start of the preheating, the preheating of the flavor source 33 is stopped, and at least the determined atomization power is supplied to the first load 21 (first discharge) to generate an aerosol. The heating of the flavor source 33 may be continued during the aerosol generation period. When the aerosol generation request ends, supply of the atomization power to the first load 21 is stopped. Thereafter, the flavor component remaining amount is updated, the target temperature of the flavor source 33 is reset, and the above operation is repeated. The supply of the atomization power to the first load 21 may be stopped when a predetermined time has elapsed since a start of the supply of the atomization power to the first load 21 even if the aerosol generation request is continued. Also in this case, the flavor component remaining amount is updated, the target temperature of the flavor source 33 is reset, and the above operation is repeated.

Figure 7:
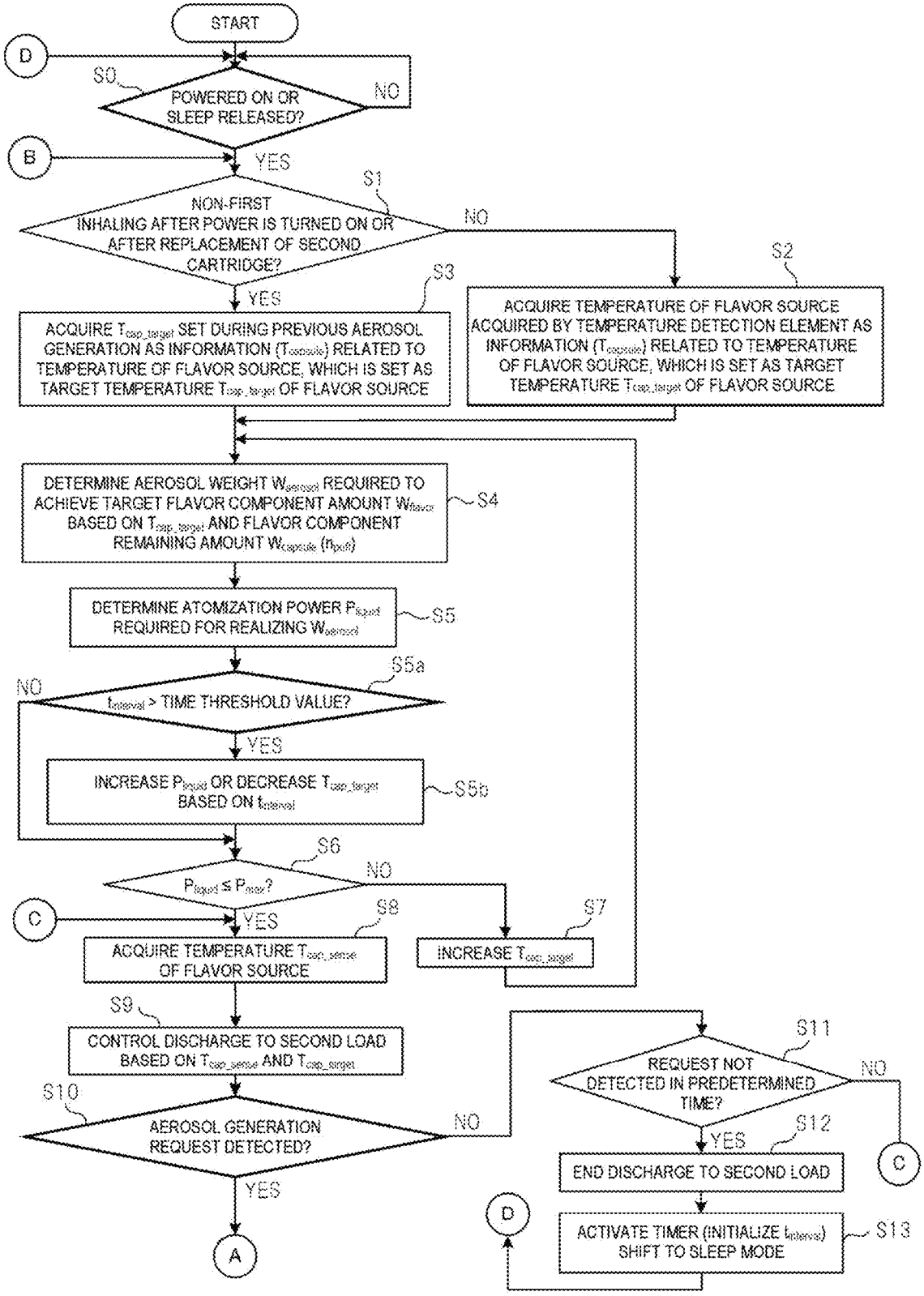
Figure 8:
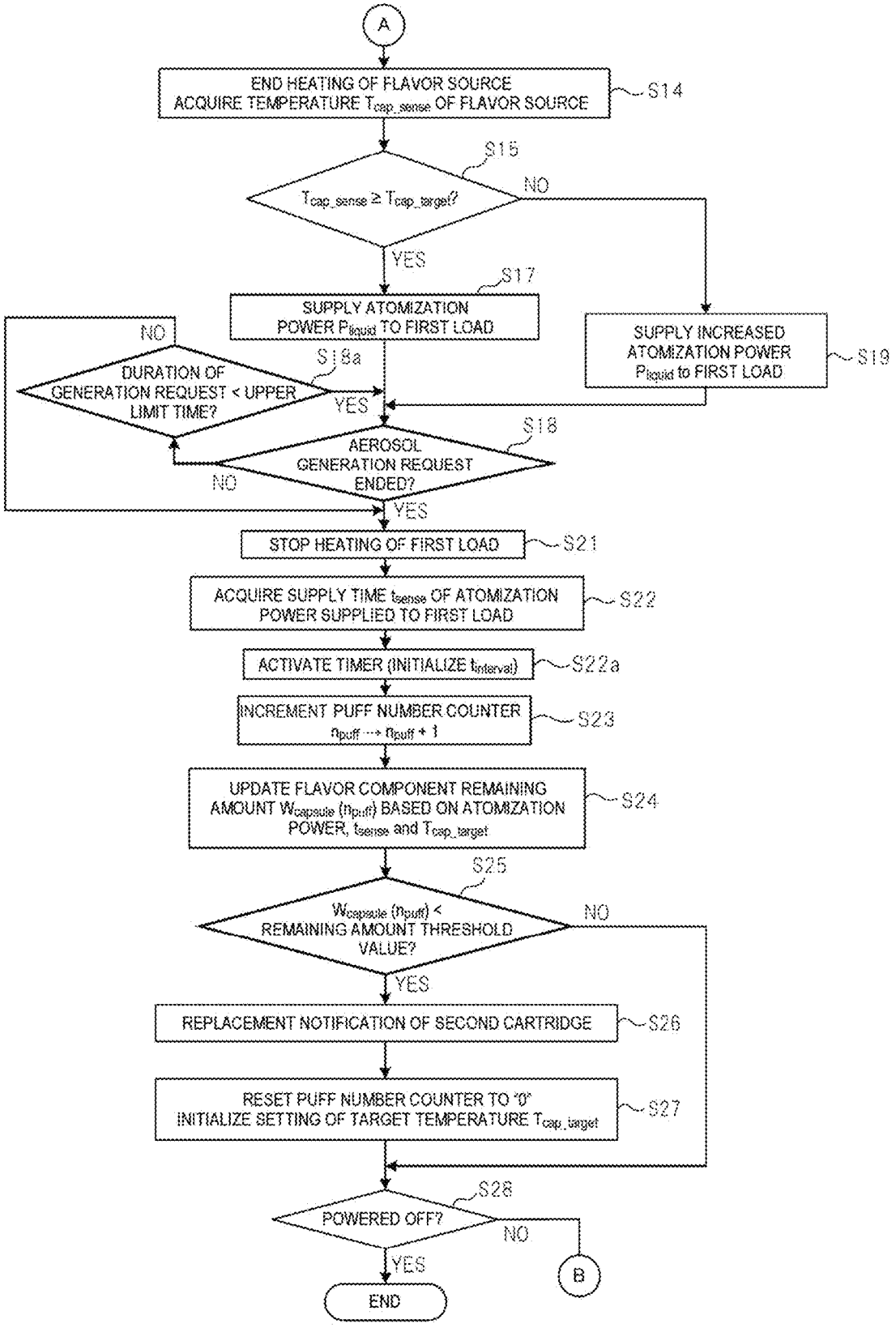

FIGS. 7 and 8 are flowcharts for explaining the operation of the aerosol generation device 1 in FIG. 1. When the aerosol generation device 1 is activated (power is turned on and the operation is started in the activation mode or a mode is returned from the sleep mode to the activation mode) by an operation of the operation unit 14 or the like (step 50: YES), the MCU 50 determines whether an aerosol is generated (whether inhaling by the user is performed even once) after the power is turned on or after the second cartridge 30 is replaced (step S1).

For example, the MCU 50 includes a built-in puff number counter that counts up $n_{puff}$ from an initial value (for example, 0) each time the inhaling (an aerosol generation request) is performed. A count value of the puff number counter is stored in the memory 50*a*. The MCU 50 determines whether the state is a state after the inhaling is performed even once with reference to the count value.

In a case of first inhaling after the power is turned ON or a timing before the first inhaling after the second cartridge 30 is replaced (step S1: NO), the flavor source 33 is not yet heated or heating is not yet performed for a while, and a temperature of the flavor source 33 is highly likely to depend on an external environment. Therefore, in this case, the MCU 50 acquires the temperature of the flavor source 33 acquired based on an output of the temperature detection element T1 (or the temperature detection element T3) as the capsule temperature parameter $T_{capsule}$, sets the acquired temperature of the flavor source 33 as the target temperature $T_{cap_target}$ of the flavor source 33, and stores the target temperature $T_{cap_target}$ in the memory 50*a* (step S2).

When the determination in step S1 is NO, the temperature of the flavor source 33 is highly likely to be close to an outside air temperature or a temperature of the power supply unit 10. Therefore, in step S2, as a modification, the outside air temperature or the temperature of the power supply unit 10 may be acquired as the capsule temperature parameter $T_{capsule}$, which may be set as the target temperature $T_{cap_target}$.

The outside air temperature is preferably acquired from, for example, a temperature sensor built in the intake sensor 15. The temperature of the power supply unit 10 is preferably acquired from, for example, a temperature sensor built in the MCU 50 in order to manage a temperature inside the MCU 50. In this case, both the temperature sensor built in the intake sensor 15 and the temperature sensor built in the MCU 50 function as elements that output information related to the temperature of the flavor source 33.

In the aerosol generation device 1, as described above, discharge from the power supply 12 to the second load 31 is controlled such that the temperature of the flavor source 33 converges to the target temperature $T_{cap_target}$. Therefore, after the inhaling is performed even once after the power is turned ON or the second cartridge 30 is replaced, the temperature of the flavor source 33 is highly likely to be close to the target temperature $T_{cap_target}$. Therefore, in this case (step S1: YES), the MCU 50 acquires the target temperature $T_{cap_target}$ stored in the memory 50*a* and used for the previous aerosol generation as the capsule temperature parameter $T_{capsule}$, which is directly set as the target temperature $T_{cap_target}$ (step S3). In this case, the memory 50*a* functions as an element that outputs information related to the temperature of the flavor source 33.

In step S3, the MCU 50 may acquire the temperature of the flavor source 33 acquired based on the output of the temperature detection element T1 (or the temperature detection element T3) as the capsule temperature parameter $T_{capsule}$, and set the acquired temperature of the flavor source 33 as the target temperature $T_{cap_target}$ of the flavor source 33. In this way, the capsule temperature parameter $T_{capsule}$ can be acquired more accurately.

After step S2 or step S3, the MCU 50 determines the aerosol weight $W_{aerosol}$ required to achieve the target flavor component amount $W_{flavor}$ by the calculation of Equation (4)

based on the set target temperature $T_{cap_target}$ and the flavor component remaining amount $W_{capsule}$ ($n_{puff}$) of the flavor source 33 at the present time point (step S4). Equation (4) is obtained by modifying Equation (2) in which $T_{capsule}$ is $T_{cap_target}$.

$$W_{aerosol} = \frac{W_{flavor}}{\beta \times W_{capsule}(n_{puff}) \times T_{cap_target} \times \gamma} \quad (4)$$

Next, the MCU 50 determines the atomization power $P_{liquid}$ required for realizing the aerosol weight $W_{aerosol}$ determined in step S4 by the calculation of Equation (1) in which $t_{sense}$ is the upper limit time topper (step S5).

A table in which a combination of the target temperature $T_{cap_target}$ and flavor component remaining amount $W_{capsule}$ ($n_{puff}$) is associated with the atomization power $P_{liquid}$ may be stored in the memory 50*a* of the MCU 50, and the MCU 50 may determine the atomization power $P_{liquid}$ using the table. Thereby, the atomization power $P_{liquid}$ can be determined at high speed and low power consumption.

After step S5, the MCU 50 determines whether an elapsed time $t_{interval}$ exceeds a time threshold value (step S5*a*). The time threshold value is a predetermined value greater than 0. The elapsed time $t_{interval}$ is an elapsed time from an aerosol generation end time point when the previous aerosol generation (the first discharge) ends to a preheating start time point when the current preheating of the flavor source 33 (the second discharge) is started. The aerosol generation end time point is a timing immediately after step S21 described later (a timing when the processing of step S22*a* is performed). The preheating of the flavor source 33 is started in step S9 described later. A time from an end of the processing of step S5 to a start of the processing of step S9 is short. Therefore, a timing immediately after the processing of step S5 ends can be regarded as the preheating start time point.

It is assumed that the preheating of the flavor source 33 is started after the end of the aerosol generation (the first discharge), and in this state, a time during which the aerosol generation request is not performed (hereinafter referred to as a non-operation time) reaches a predetermined time. In this case, in step S13 described later, the preheating of the flavor source 33 is stopped, and the power supply unit 10 shifts from the activation mode to the sleep mode. Thereafter, when the sleep mode is released in step S0, the elapsed time $t_{interval}$ in step S5*a* is an elapsed time from a timing of shifting to the sleep mode, in other words, a preheating end time point when the previous preheating of the flavor source 33 (the second discharge) ends, to a current preheating start time point of the flavor source 33.

It is also assumed that the aerosol generation device 1 is powered OFF and left for a while after the end of the aerosol generation (the first discharge), and then the aerosol generation device 1 is powered ON. In this case, the elapsed time $t_{interval}$ in step S5*a* is the elapsed time from an aerosol generation end time point immediately before the power is turned OFF (an end time point of the previous first discharge) to the preheating start time point.

The elapsed time $t_{interval}$ is a length of a leaving period during which the aerosol is not generated and the flavor source 33 is not heated. In the aerosol generation device 1, control on discharge to the first load 21 and the second load 31 is performed such that the flavor component contained in the flavor source 33 is consumed in a target amount by one time of inhaling. However, when the leaving period becomes long, the flavor component contained in the flavor source 33 is slightly transferred to the filter 34 by an amount corresponding to the length of the leaving period and is adsorbed to the filter 34. When the control on the discharge to the first load 21 and the second load 31 is performed such that the aerosol containing a target flavor component amount can be generated in a state where the flavor component is adsorbed to the filter 34, the target flavor component amount is added to the aerosol generated on an upstream side of the filter 34. However, when the aerosol containing the target flavor component amount passes through the filter 34, if the flavor component adsorbed to the filter 34 is transported to a mouth of the user together with the aerosol, the flavor component amount in the aerosol transported to the mouth of the user becomes larger than a target value. In particular, the flavor component adsorbed to the filter 34 is more likely to be together with the aerosol than the flavor component not adsorbed to the filter 34 in the flavor source 33. The filter 34 is accommodated in the inhale port 32, and is positioned at a position close to the mouth of the user. Therefore, when the inhaling is performed in a state where the flavor component is adsorbed to the filter 34, the flavor component is strongly perceived by the user. As a result, even when a slight amount of flavor component is adsorbed to the filter 34, a flavor of the aerosol may change.

Therefore, when the determination in step S5*a* is YES, the MCU 50 determines that an amount of the flavor component that affects the flavor is transferred to the filter 34. Then, the MCU 50 increases the atomization power $P_{liquid}$ determined in step S5 based on the elapsed time $t_{interval}$, or decreases the target temperature $T_{cap_target}$ determined in step S2 or step S3 based on the elapsed time $t_{interval}$ (step S5*b*). After step S5*b*, the MCU 50 performs the processing of step S6. The elapsed time $t_{interval}$ has a strong positive correlation with an amount of the flavor component adsorbed to the filter 34. Therefore, the processing of step S5*a* can be said to be a processing of estimating the amount of the flavor component adsorbed to the filter 34.

By increasing the atomization power $P_{liquid}$ determined in step S5, the aerosol weight $W_{aerosol}$ when the increased atomization power $P_{liquid}$ is supplied to the first load 21 increases. Therefore, even when the flavor component is transferred to the filter 34, an increase in a proportion of the flavor component in the aerosol transported to the mouth of the user can be prevented. An increase amount of the atomization power $P_{liquid}$ may be a value proportional to the elapsed time $t_{interval}$ having the correlation with the amount of the flavor component transferred to the filter 34. Thereby, the flavor of the aerosol can be stabilized.

When the target temperature $T_{cap_target}$ set in step S2 or step S3 decreases without changing the atomization power $P_{liquid}$, the flavor component amount added to the aerosol decreases with respect to the target amount. Therefore, the increase in the proportion of the flavor component in the aerosol transported to the mouth of the user can be prevented. A decrease amount of the target temperature $T_{cap_target}$ may be a value proportional to the elapsed time $t_{interval}$ having the correlation with the amount of the flavor component adsorbed to the filter 34.

In step S5*b*, the MCU 50 may perform both the processing of increasing the atomization power $P_{liquid}$ determined in step S5 and the processing of decreasing the target temperature $T_{cap_target}$ determined in step S2 or step S3. In this way, the increase amount of the atomization power and the decrease amount of the target temperature can be set to small values as compared with a case where one of the processing is performed. Since the increase amount of the atomization power can be reduced, power consumption can be reduced.

When the determination in step S5*a* is NO, the MCU 50 determines that the flavor component is not transferred to the filter 34 in an amount that affects the flavor, and performs the processing in step S6 without performing the processing in step S5*b*.

In the aerosol generating device 1, as will be described later, when the temperature of the flavor source 33 does not reach the target temperature at a time point when the aerosol generation request is detected, a shortage of the flavor component amount $W_{flavor}$ is compensated for by an increase in the aerosol weight $W_{aerosol}$ (an increase in the atomization power). In order to ensure the increase in the atomization power, the atomization power determined in step S5 or step S5*b* needs to be lower than an upper limit value $P_{upper}$ of the power that can be supplied to the first load 21 determined by the hardware configuration.

Specifically, when the atomization power $P_{liquid}$ determined in step S5 or step S5*b* exceeds a power threshold value $P_{max}$ lower than the upper limit value $P_{upper}$ (step S6: NO), the MCU 50 increases the target temperature $T_{cap_target}$ of the flavor source 33 (step S7), and returns the processing to step S4. As can be seen from Equation (4), by increasing the target temperature $T_{cap_target}$, the aerosol weight $W_{aerosol}$ required to achieve the target flavor component amount $W_{flavor}$ can be reduced. As a result, the atomization power $P_{liquid}$ determined in step S5 can be reduced. By repeating steps S4 to S7, the MCU 50 can set the determination in step S6, which was initially determined to be NO, to YES, and shift the processing to step S8.

When the atomization power $P_{liquid}$ determined in step S5 or step S5*b* is equal to or smaller than the power threshold value $P_{max}$ (step S6: YES), the MCU 50 acquires a temperature $T_{cap_sense}$ of the flavor source 33 at the present time point based on the output of the temperature detection element T1 (or the temperature detection element T3) (step S8).

Then, the MCU 50 controls the discharge to the second load 31 for heating the second load 31 based on the temperature $T_{cap_sense}$ and the target temperature $T_{cap_target}$ (step S9). Specifically, the MCU 50 supplies the power to the second load 31 by proportional-integral-differential (PID) control or ON/OFF control such that the temperature $T_{cap_sense}$ converges to the target temperature $T_{cap_target}$.

In the PID control, a difference between the temperature $T_{cap_sense}$ and the target temperature $T_{cap_target}$ is fed back, and power control is performed based on the feedback result such that the temperature $T_{cap_sense}$ converges to the target temperature $T_{cap_target}$. According to the PID control, the temperature $T_{cap_sense}$ can converge to the target temperature $T_{cap_target}$ with high accuracy. The MCU 50 may use proportional (P) control or proportional-integral (PI) control instead of the PID control.

The ON/OFF control is control in which the power is supplied to the second load 31 in a state where the temperature $T_{cap_sense}$ is lower than the target temperature $T_{cap_target}$, and power supply to the second load 31 is stopped until the temperature $T_{cap_sense}$ becomes lower than the target temperature $T_{cap_target}$ in a state where the temperature $T_{cap_sense}$ is equal to or higher than the target temperature $T_{cap_target}$. According to the ON/OFF control, the temperature of the flavor source 33 can be increased faster than the PID control. Therefore, it is possible to increase a possibility that the temperature $T_{cap_sense}$ reaches the target temperature $T_{cap_target}$ before the aerosol generation request described later is detected. The target temperature $T_{cap_target}$ may have hysteresis.

After step S9, the MCU 50 determines whether there is an aerosol generation request (step S10). When the aerosol generation request is not detected (step S10: NO), the MCU 50 determines a length of the non-operation time during which the aerosol generation request is not performed in step S11. When the non-operation time reaches a predetermined time (step S11: YES), the MCU 50 ends the discharge to the second load 31 (the preheating of the flavor source 33) (step S12), initializes the elapsed time $t_{interval}$ to the initial value "0", starts measurement of the elapsed time $t_{interval}$ from the initial value by a built-in timer, and further shifts to the sleep mode in which the power consumption is reduced (step S13). When the non-operation time is shorter than the predetermined time (step S11: NO), the MCU 50 shifts the processing to step S8.

When the aerosol generation request is detected (step S10: YES), the MCU 50 ends the discharge to the second load 31, and acquires the temperature $T_{cap_sense}$ of the flavor source 33 at that time point based on the output of the temperature detection element T1 (or the temperature detection element T3) (step S14). Then, the MCU 50 determines whether the temperature $T_{cap_sense}$ acquired in step S14 is equal to or higher than the target temperature $T_{cap_target}$ (step S15).

When the temperature $T_{cap_sense}$ is lower than the target temperature $T_{cap_target}$ (step S15: NO), the MCU 50 increases the atomization power $P_{liquid}$ determined in step S5 or step S5*b* in order to compensate for a decrease in the flavor component amount due to an insufficient temperature of the flavor source 33. Specifically, the MCU 50 supplies the atomization power $P_{liquid'}$ obtained by adding a predetermined increase amount $\Delta P$ to the atomization power $P_{liquid}$ determined in step S5 or step S5*b* to the first load 21 to start heating of the first load 21 (step S19). The increase amount $\Delta P$ is set to any positive value equal to or smaller than a value obtained by subtracting the power threshold value $P_{max}$ from the upper limit value $P_{upper}$.

In step S15, when the temperature $T_{cap_sense}$ is equal to or higher than the target temperature $T_{cap_target}$ (step S15: YES), the MCU 50 supplies the atomization power $P_{liquid}$ determined in step S5 or step S5*b* to the first load 21 to start the heating of the first load 21, and generates the aerosol (step S17).

After the heating of the first load 21 is started in step S19 or step S17, when the aerosol generation request does not end (step S18: NO), and if duration of the aerosol generation request is shorter than the upper limit time topper (step S18*a*: YES), the MCU 50 continues the heating of the first load 21. When the duration of the aerosol generation request reaches the upper limit time $t_{upper}$ (step S18*a*: NO) and when the aerosol generation request ends (step S18: YES), the MCU 50 stops the power supply to the first load 21 (step S21).

The MCU 50 may control the heating of the first load 21 in step S17 or step S19 based on an output of the temperature detection element T2. For example, if the MCU 50 performs the PID control or the ON/OFF control using a boiling point of the aerosol source 22 as the target temperature based on the output of the temperature detection element T2, overheating of the first load 21 and the aerosol source 22 can be prevented, and an amount of the aerosol source 22 atomized by the first load 21 can be highly controlled.

Figure 9:
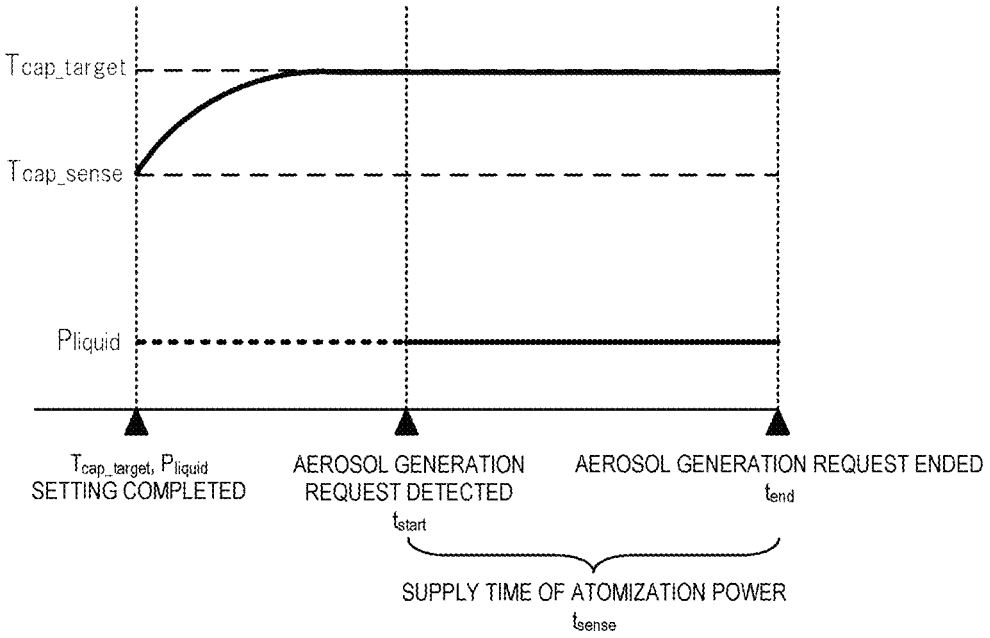
FIG. 9 is a schematic view showing atomization power supplied to a first load 21 in step S17 of FIG. 8.
Figure 10:
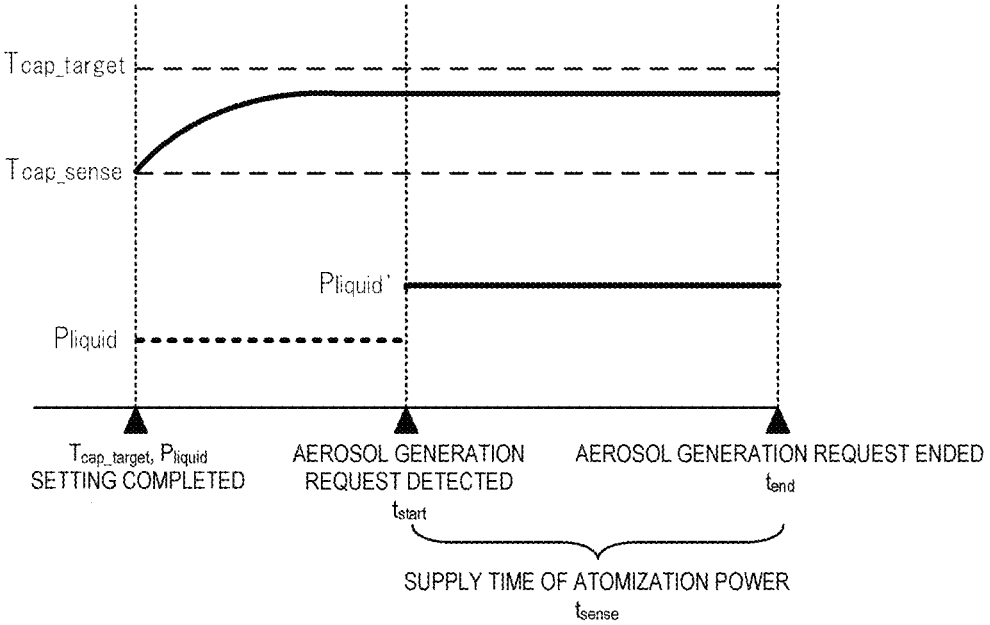
FIG. 10 is a schematic view showing the atomization power supplied to the first load 21 in step S19 of FIG. 8.

FIG. 9 is a schematic view showing the atomization power supplied to the first load 21 in step S17 of FIG. 8. FIG. 10 is a schematic view showing the atomization power supplied to the first load 21 in step S19 of FIG. 8. As shown in FIG. 10, when the temperature $T_{cap_sense}$ does not reach the target temperature $T_{cap_target}$ at a time point when the aerosol generation request is detected, the atomization power $P_{liquid}$ is increased and then supplied to the first load 21.

In this way, even when the temperature of the flavor source 33 does not reach the target temperature at a time point when the aerosol generation request is made, an amount of the aerosol to be generated can be increased by performing the processing of step S19. As a result, the decrease in the flavor component amount added to the aerosol due to the temperature of the flavor source 33 being lower than the target temperature can be compensated for by an increase in the amount of the aerosol. Therefore, the flavor component amount added to the aerosol can converge to a target amount.

On the other hand, when the temperature of the flavor source 33 has reached the target temperature at the time point when the aerosol generation request is made, a desired amount of the aerosol required to achieve the target flavor component amount is generated by the atomization power determined in step S5. Therefore, the flavor component amount added to the aerosol can converge to the target amount.

After step S21, the MCU 50 acquires the supply time $t_{sense}$ of the atomization power supplied to the first load 21 in step S17 or step S19 (step S22). When the MCU 50 detects the aerosol generation request beyond the upper limit time $t_{upper}$, the supply time $t_{sense}$ is equal to the upper limit time $t_{upper}$. Further, the MCU 50 initializes the elapsed time $t_{interval}$ to the initial value "0", starts measurement of the elapsed time $t_{interval}$ from the initial value by the built-in timer (step S22*a*), and increments the puff number counter by "1" (step S23).

The MCU 50 updates the flavor component remaining amount $W_{capsule}$ ($n_{puff}$) of the flavor source 33 based on the supply time $t_{sense}$ acquired in step S22, the atomization power supplied to the first load 21 in response to the aerosol generation request, and the target temperature $T_{cap_target}$ at the time point when the aerosol generation request is detected (step S24).

When the control shown in FIG. 9 is performed, the flavor component amount $W_{flavor}$ added to the aerosol generated from a start to an end of the aerosol generation request can be obtained by the following Equation (7). In Equation (7), ($t_{end}-t_{start}$) represents the supply time $t_{sense}$. The flavor component remaining amount $W_{capsule}$ ($n_{puff}$) in Equation (7) is a value at a time point immediately before the aerosol generation request is performed.

$$W_{flavor}=\beta\times\{W_{capsule}(n_{puff})\times T_{cap_target}\}\times\gamma\times\alpha\times P_{liquid}\times(t_{end}-t_{start}) \quad (7)$$

When the control shown in FIG. 10 is performed, the flavor component amount $W_{flavor}$ added to the aerosol generated from the start to the end of the aerosol generation request can be obtained by the following Equation (7A). In Equation (7A), ($t_{end}-t_{start}$) represents the supply time $t_{sense}$. The flavor component remaining amount $W_{capsule}$ ($n_{puff}$) in Equation (7A) is a value at the time point immediately before the aerosol generation request is performed.

$$W_{flavor}=\beta\times\{W_{capsule}(n_{puff})\times T_{cap_target}\}\times\gamma\times\alpha\times P_{liquid}\times(t_{end}-t_{start}) \quad (7A)$$

The thus obtained $W_{flavor}$ for each aerosol generation request is stored in the memory 50*a*, and values of the past flavor component amounts $W_{flavor}$ including the flavor component amount $W_{flavor}$ at the time of the current aerosol generation and the flavor component amount $W_{flavor}$ at the time of the previous aerosol generation are substituted into Equation (3) (that is, a value obtained by multiplying an integrated value of the values of the past flavor component amounts $W_{flavor}$ by a coefficient δ is subtracted from $W_{initial}$), whereby the flavor component remaining amount $W_{capsule}$ ($n_{puff}$) after the aerosol generation can be derived with high accuracy and updated.

Next, the MCU 50 determines whether the updated flavor component remaining amount $W_{capsule}$ ($n_{puff}$) is smaller than a remaining amount threshold value (step S25). When the updated flavor component remaining amount $W_{capsule}$ ($n_{puff}$) is equal to or greater than the remaining amount threshold value (step S25: NO), the MCU 50 shifts the processing to step S28. When the updated flavor component remaining amount $W_{capsule}$ ($n_{puff}$) is smaller than the remaining amount threshold value (step S25: YES), the MCU 50 causes at least one of the first notification unit 45 and the second notification unit 46 to perform a notification for prompting replacement of the second cartridge 30 (step S26). Then, the MCU 50 resets the puff number counter to the initial value (=0), deletes the values of the past $W_{flavor}$ described above, and further initializes the target temperature $T_{cap_target}$ (step S27).

The initialization of the target temperature $T_{cap_target}$ means that the target temperature $T_{cap_target}$ at that time point stored in the memory 50*a* is excluded from a set value. As another example, when step S3 is always performed without step S1 and step S2, the initialization of the target temperature $T_{cap_target}$ means that the target temperature $T_{cap_target}$ at that time point stored in the memory 50*a* is set to a normal temperature or a room temperature.

After step S27, when the power is not turned off (step S28: NO), the MCU 50 returns the processing to step S1, and when the power is turned off (step S28: YES), the MCU 50 ends the processing. The built-in timer of the MCU 50 for measuring the elapsed time $t_{interval}$ can continue a time measurement operation even when the power is turned off. After step S26 and step S27, the MCU 50 may shift the processing to step S28 when detecting that the second cartridge 30 is attached/detached (the replacement of the second cartridge 30). The attachment and detachment of the second cartridge 30 may be detected by, for example, a dedicated sensor or the like provided in the power supply unit 10. Alternatively, the user may manually input from the operation unit 14 that the replacement is performed, and detection can be performed according to this input.

Effects of Embodiment

As described above, according to the aerosol generation device 1, each time the user inhales the aerosol, the discharge from the power supply 12 to the first load 21 and the second load 31 is controlled such that the flavor component amount contained in the aerosol converges to the target amount. Therefore, the flavor component amount provided to the user can be stabilized for each inhaling, and a commercial value of the aerosol generation device 1 can be increased. As compared with a case where the discharge is performed only on the first load 21, the flavor component amount (the flavor) for each inhaling provided to the user can be stabilized, and the commercial value of the aerosol generation device 1 can be further increased.

In the aerosol generation device 1, when the elapsed time $t_{interval}$ exceeds the time threshold value at the preheating start time point of the flavor source 33 and it can be determined that a part of the flavor component of the flavor source 33 is transferred to the filter 34, at least one of the atomization power and the target temperature is changed.

Thereby, a change in the flavor due to the flavor component adsorbed to the filter 34 can be offset by increasing the aerosol weight or decreasing the flavor component amount. As a result, the change in the flavor of the aerosol between a case where the aerosol generation device 1 is left for a long time and a case where the aerosol generation device 1 is not left for a long time can be prevented.

First Modification of Aerosol Generation Device

Figure 11:
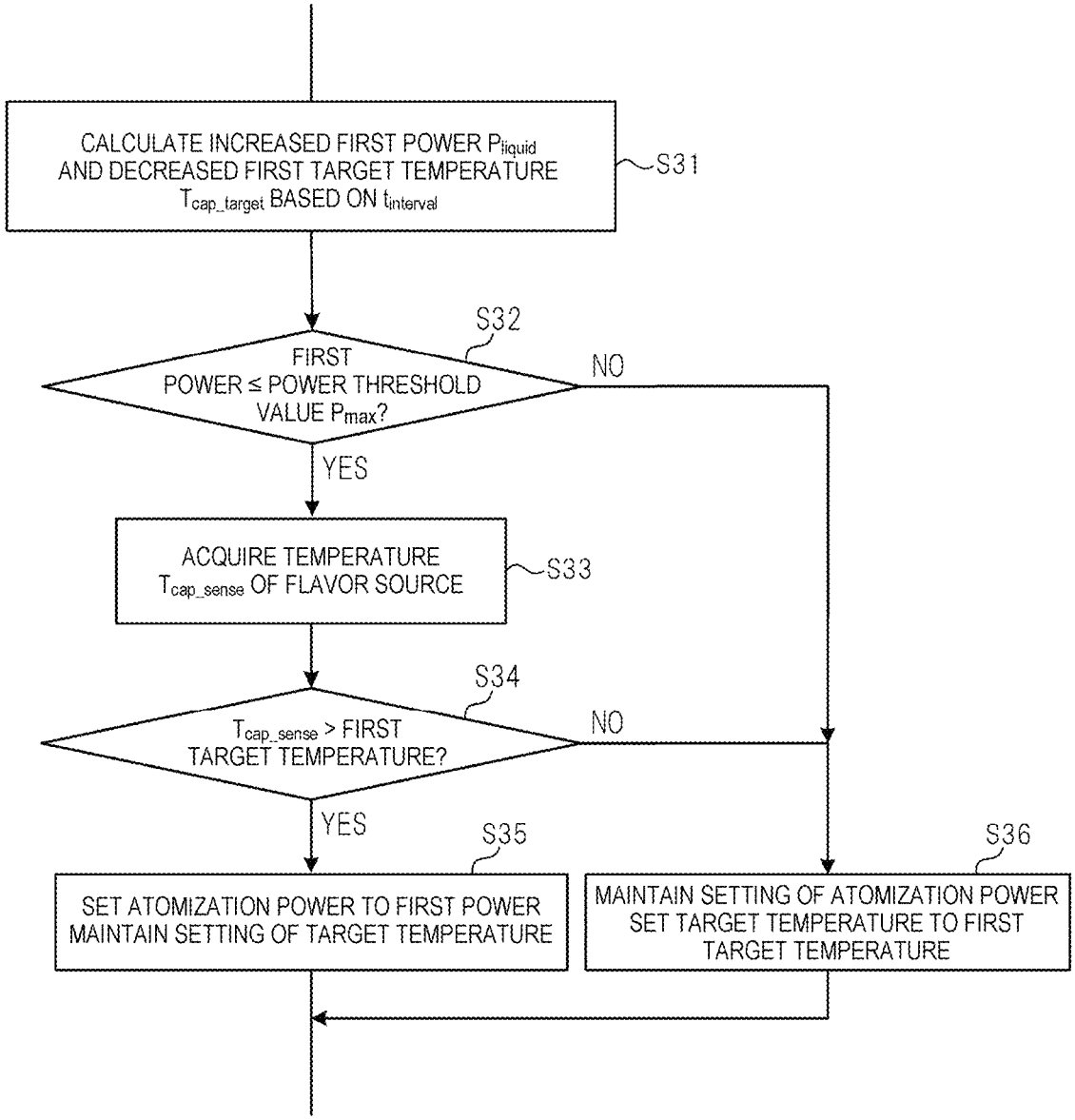
FIG. 11 is a flowchart for explaining a modification of step S5*b* of FIG. 7.

The processing of step S5*b* in FIG. 7 may be modified to a flow shown in FIG. 11. First, the MCU 50 calculates the increased atomization power $P_{liquid}$ (hereinafter referred to as first power) when the atomization power $P_{liquid}$ determined in step S5 is increased by an amount based on the elapsed time $t_{interval}$. The MCU 50 calculates the decreased target temperature $T_{cap_target}$ (hereinafter, referred to as a first target temperature) when the target temperature set in step S2 or step S3 is decreased by a value based on the elapsed time $t_{interval}$ (step S31). The first target temperature may not necessarily be calculated in step S31, and may be calculated at any timing after step S31 and before step S33.

Next, the MCU 50 determines whether the first power is equal to or smaller than the power threshold value $P_{max}$ (step S32). When the first power exceeds the power threshold value $P_{max}$ (step S32: NO), the MCU 50 maintains the atomization power $P_{liquid}$ determined in step S5 as it is, and decreases the target temperature $T_{cap_target}$ set in step S2 or step S3 to the first target temperature (step S36).

When the first power is equal to or smaller than the power threshold value $P_{max}$ (step S32: YES), the MCU 50 acquires the temperature $T_{cap_sense}$ of the flavor source 33 at the present time point based on the output of the temperature detection element T1 (or the temperature detection element T3) (step S33). Then, the MCU 50 determines whether the temperature $T_{cap_sense}$ exceeds the first target temperature (step S34).

When the temperature $T_{cap_sense}$ exceeds the first target temperature (step S34: YES), the MCU 50 increases the atomization power $P_{liquid}$ determined in step S5 to the first power, and maintains the target temperature $T_{cap_target}$ set in step S2 or step S3 as it is (step S35).

When the temperature $T_{cap_sense}$ is equal to or lower than the first target temperature (step S34: NO), the MCU 50 maintains the atomization power $P_{liquid}$ determined in step S5 as it is, and decreases the target temperature $T_{cap_target}$ set in step S2 or step S3 to the first target temperature (step S36).

As described above, when the first power calculated based on the determined atomization power and the elapsed time $t_{interval}$ exceeds the power threshold value $P_{max}$, the processing of decreasing the target temperature is performed without performing the processing of increasing the determined atomization power. Therefore, even when it is difficult to increase the power supplied to the first load 21, the same flavor as when the elapsed time $t_{interval}$ is equal to or shorter than the time threshold value can be realized.

Even when the first power calculated based on the determined atomization power and the elapsed time $t_{interval}$ is equal to or smaller than the power threshold value $P_{max}$ and the atomization power can be increased, if the first target temperature is equal to or higher than the temperature ($T_{cap_sense}$) of the flavor source 33, the process of decreasing the target temperature is performed without performing the processing of increasing the atomization power. In this way, when the target temperature is decreased, the power supplied to the second load 31 is reduced, and utilization efficiency of the power supply can be improved.

Even when the first power calculated based on the determined atomization power and the elapsed time $t_{interval}$ is equal to or smaller than the power threshold value $P_{max}$, if the first target temperature is lower than the temperature ($T_{cap_sense}$) of the flavor source 33, the processing of increasing the determined atomization power is performed without performing the processing of decreasing the target temperature. In order to decrease the temperature of the flavor source 33, more time is required than to increase the temperature of the flavor source 33. Therefore, in a state where the temperature of the flavor source 33 is higher than the first target temperature, the change in the flavor can be prevented with high accuracy by increasing the atomization power instead of decreasing the target temperature.

Second Modification of Aerosol Generation Device

Figure 12:
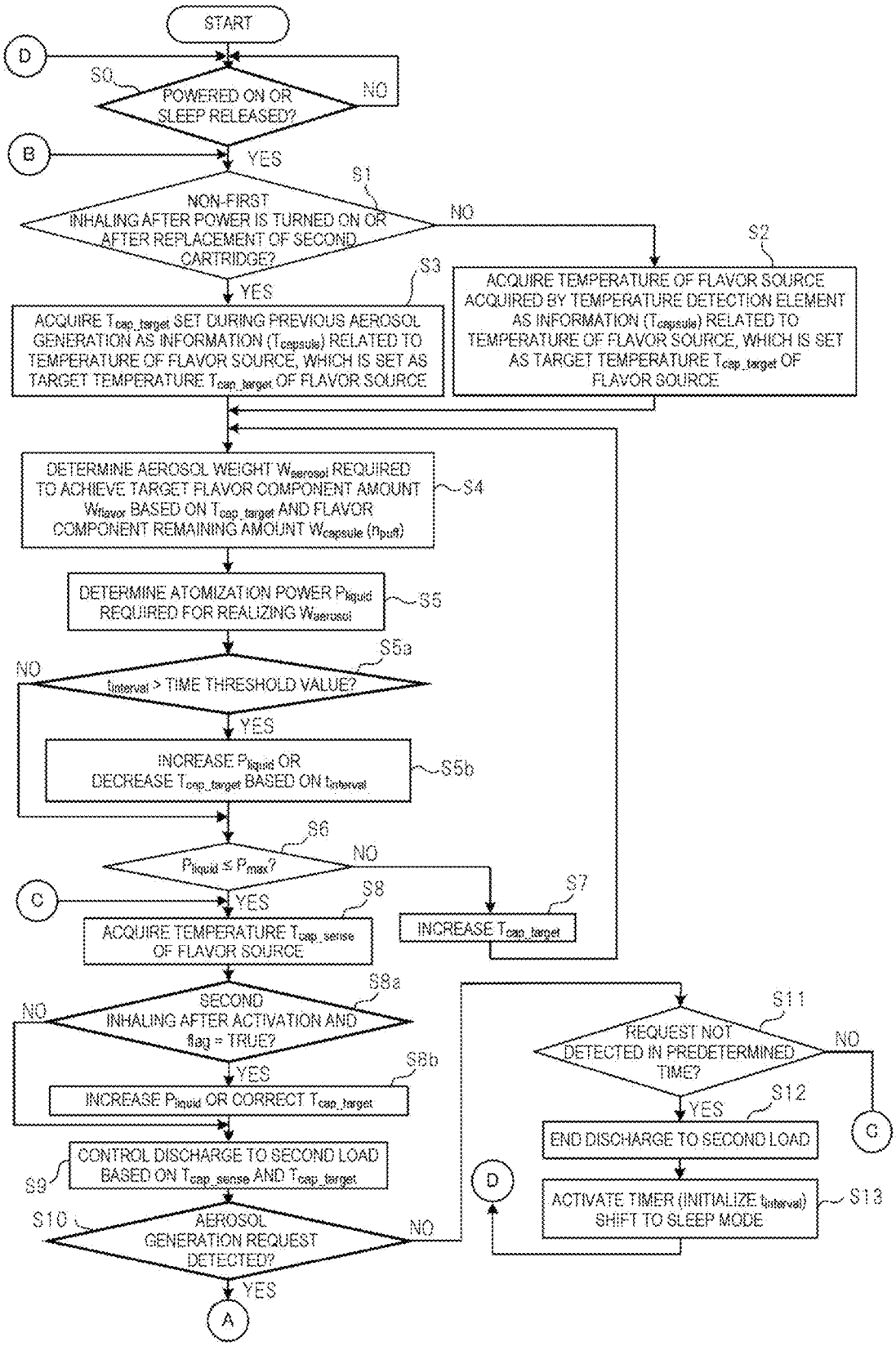
FIG. 12 is a flowchart for explaining a modification of the operation of the aerosol generation device 1.
Figure 13:
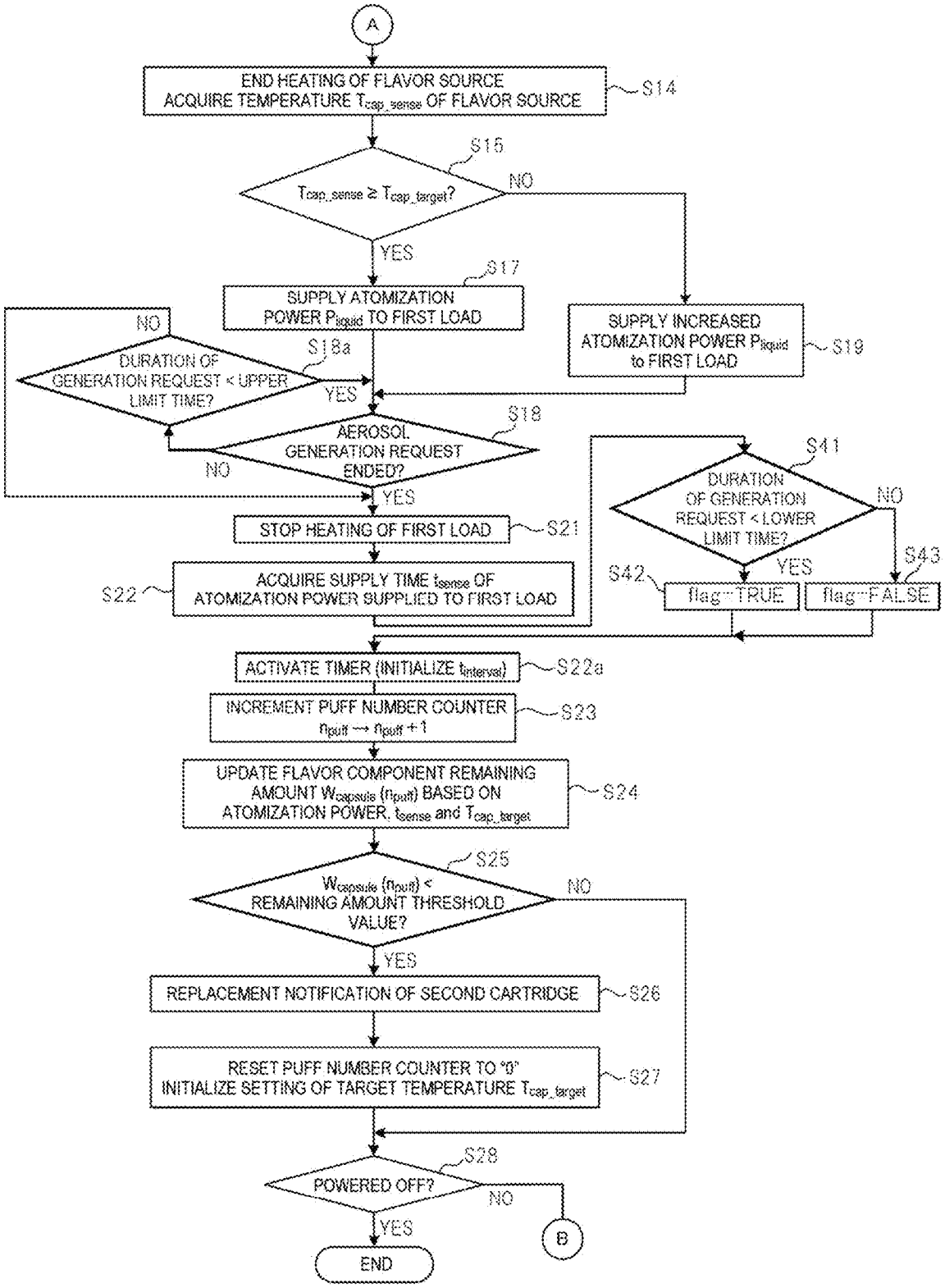
FIG. 13 is a flowchart for explaining a modification of the operation of the aerosol generation device 1.

FIGS. 12 and 13 are flowcharts for explaining a modification of the operation of the aerosol generation device 1. FIG. 12 is the same as FIG. 7 except that step S8*a* and step S8*b* are added between step S8 and step S9. FIG. 13 is the same as FIG. 8 except that steps S41 to S43 are added between steps S22 and S22*a*.

The processing of steps S41 to S43 shown in FIG. 13 is processing of determining whether the duration of the aerosol generation request performed at the time of the aerosol generation is extremely short, and holding the determination result. Specifically, after step S22, the MCU 50 determines whether the duration of the aerosol generation request (a length of the inhaling by the user) is shorter than a lower limit time (step S41). The lower limit time is a value sufficiently shorter than the upper limit time $t_{upper}$. When the duration of the aerosol generation request is shorter than the lower limit time (step S41: YES), the MCU 50 sets a flag to TRUE (step S42). When the duration of the aerosol generation request is equal to or longer than the lower limit time (step S41: NO), the MCU 50 sets the flag to FALSE (step S43). After step S42 or step S43, the processing of step S22*a* and the subsequent steps are performed.

After step S8 shown in FIG. 12, the MCU 50 determines whether a stage is before second aerosol generation is performed after a start of the operation in the activation mode, and the flag is TRUE (step S8*a*). When the flag is FALSE (step S8*a*: NO), that is, when the length of the inhaling by the user at the time of the previous aerosol generation is equal to or longer than the lower limit time, the MCU 50 shifts the processing to step S9. When the inhaling is first inhaling after the start of the operation in the activation mode or third inhaling after the start of the operation in the activation mode (step S8*a*: NO), the MCU 50 shifts the processing to step S9.

When the stage is before the second aerosol generation is performed after the start of the operation in the activation mode (step S8*a*: YES), and the flag is TRUE, that is, when the length of the inhaling by the user at the time of the first aerosol generation after the activation mode is shorter than the lower limit time, the MCU 50 shifts the processing to step S8*b*. In step S8*b*, the MCU 50 increases the atomization power $P_{liquid}$ or decreases the target temperature $T_{cap_target}$. After step S8*b*, the MCU 50 performs the processing of step S9. An amount of increase in the atomization power and an amount of decrease in the target temperature in step S8*b* may be set to values inversely proportional to an inhaling time of the previous inhaling.

As described above, when the length of the inhaling by the user at the time of the previous aerosol generation is extremely short, at least one of the atomization power and the target temperature is adjusted in step S8*b*. When the length of the inhaling by the user is extremely short, all the flavor component adsorbed to the filter 34 is not transported to the mouth of the user and remain in the filter 34. For example, it is assumed that when the elapsed time $t_{interval}$ exceeds the time threshold value, extremely short inhaling is performed, and the flavor component remains in the filter 34. In this case, the filter 34 is in a state where the flavor component transferred from the flavor source 33 in the leaving period and the flavor component remaining without being inhaled by the user are adsorbed. Therefore, when it can be determined that the remaining flavor component at the time of the previous inhaling is adsorbed to the filter 34 (step S8*a*), the change in the flavor of the aerosol at the time of next aerosol generation can be prevented by further increasing the atomization power or further decreasing the target temperature.

Third Modification of Aerosol Generation Device

During the leaving period of the aerosol generation device 1, volatilization of the flavor component may occur in the flavor source 33. A part of the volatilization amount of the flavor component can be considered as the amount of the flavor component transferred from the flavor source 33 to the filter 34 described above. Therefore, the MCU 50 may calculate the volatilization amount of the flavor component between step S5*a* and step S5*b* in FIGS. 7 and 12, and may determine at least one of an increase range of the atomization power and a decrease range of the target temperature based on the elapsed time and the volatilization amount in step S5*b*. Specifically, the MCU 50 increases the atomization power more or decreases the target temperature more as the volatilization amount increases.

The volatilization amount is a part of the flavor component remaining amount updated in step S24 of FIG. 8. Therefore, for example, a value obtained by multiplying the flavor component remaining amount by a predetermined ratio (0.1%, 1% or the like) is calculated as the volatilization amount. The predetermined ratio may be set to a larger value as the elapsed time $t_{interval}$ is longer.

In this way, in step S5*b*, by performing at least one of the processing of increasing the atomization power and the processing of decreasing the target temperature based on the flavor component remaining amount having a correlation with the volatilization amount, the change of the flavor can also be prevented.

Fourth Modification of Aerosol Generation Device

Figure 14:
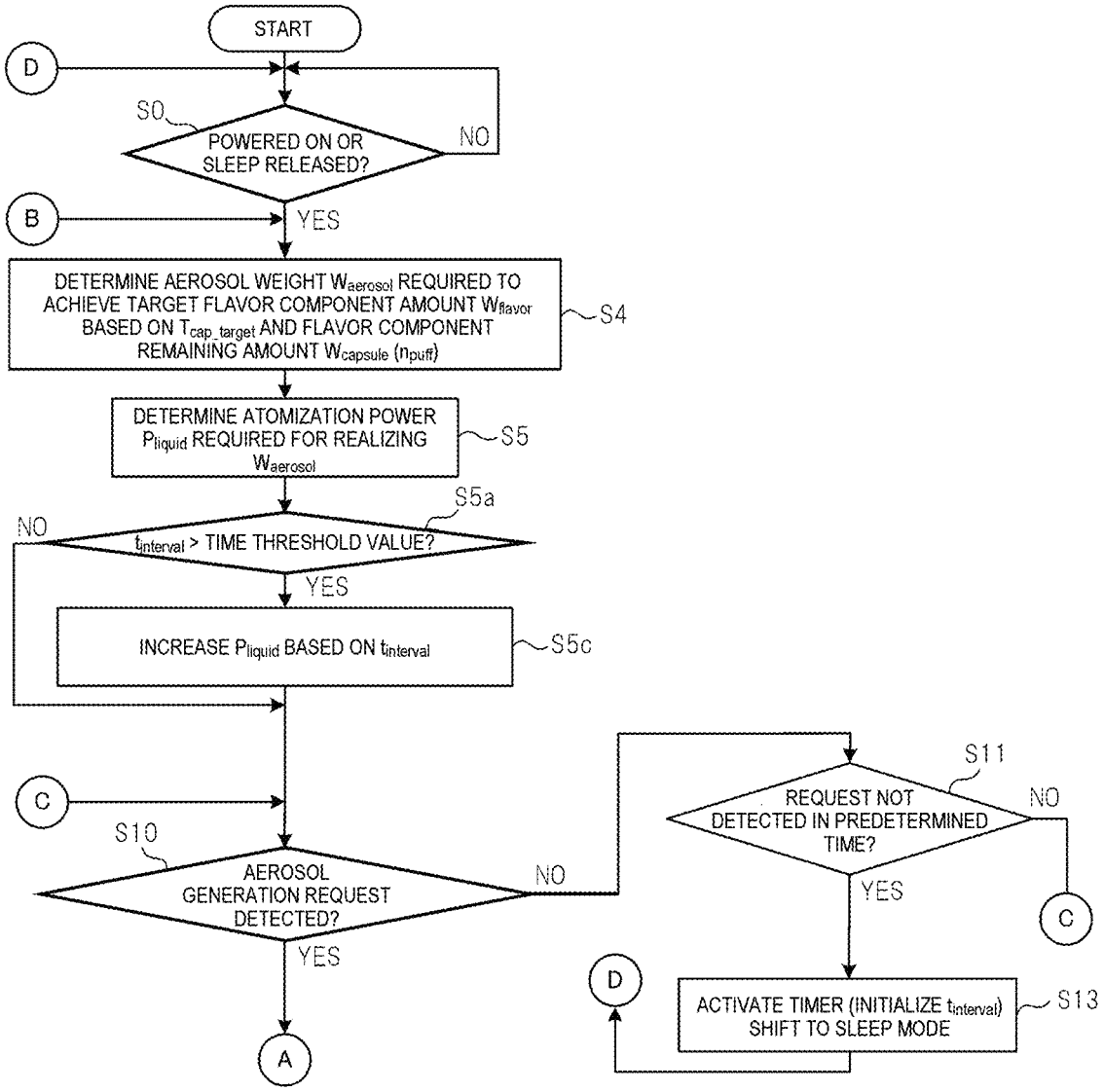
FIG. 14 is a flowchart for explaining a modification of the operation of the aerosol generation device 1.
Figure 15:
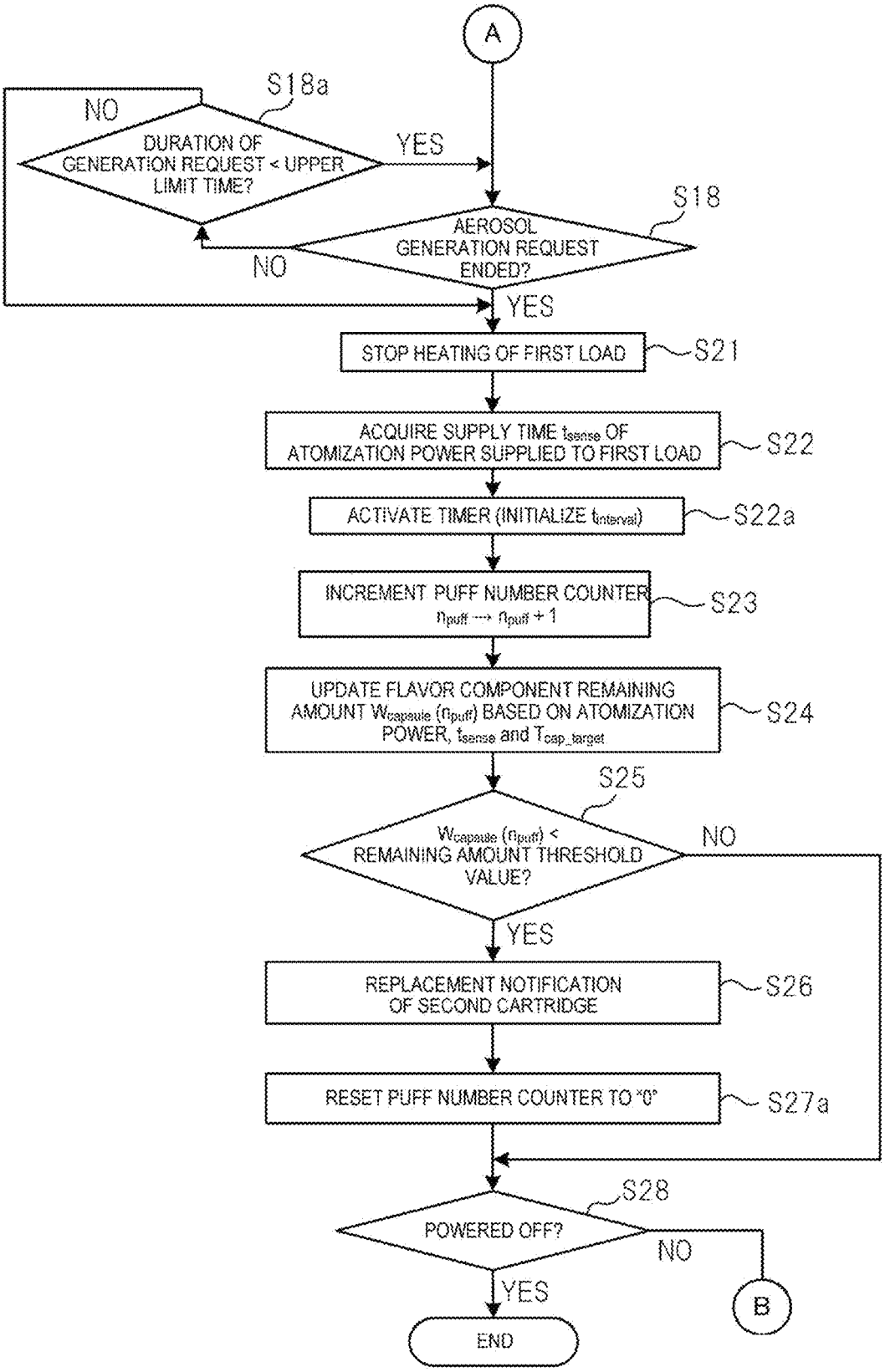
FIG. 15 is a flowchart for explaining a modification of the operation of the aerosol generation device 1.

In the aerosol generation device 1, the heating of the flavor source 33 is not essential, and may be omitted. In this case, for example, the above-described target temperature is treated as a fixed value. FIGS. 14 and 15 are flowcharts for describing a modification of the operation of the aerosol generation device 1. FIG. 14 is the same as FIG. 7 except that step S1 to step S3 are deleted and step S4 is performed when the determination of step S0 is YES, step S5*b* is changed to step S5*c*, step S6 to step S9 are deleted and step S10 is performed after step S5*c*, and step S12 is deleted and step S13 is performed when the determination of step S11 is YES. In step S5*c*, the MCU 50 increases the atomization power determined in step S5 based on the elapsed time.

FIG. 15 is the same as FIG. 8 except that step S14, step S15, step S17 and step S19 are deleted, and step S27 is changed to step S27*a*. In step S27*a*, the MCU 50 resets the puff number counter.

As described above, even when the flavor source 33 is not heated, the change in the flavor can be prevented by increasing the atomization power according to the amount of the flavor component transferred to the filter 34.

In the aerosol generation device 1 described so far, the processing of steps S5*a* and S5*b* in FIGS. 7 and 12 and the processing of steps S5*a* and S5*c* in FIG. 14 may be performed only when the aerosol is generated for the first time after the power supply unit 10 starts operating in the activation mode (either when the power supply unit 10 is switched from a power-off state to a power-on state or when the power supply unit 10 returns from the sleep mode to the activation mode). In a normal use state where the inhaling is continuously performed after the start of the operation in the activation mode, the flavor component is less likely to be transferred to the filter 34. Therefore, in the normal use state, the processing of step S5*a* and step S5*b* or step S5*a* and step S5*c* immediately before the second or subsequent inhaling are omitted, so that power saving can be achieved.

In the aerosol generation device 1 described so far, the first load 21 may include elements that can atomize the aerosol source 22 without heating the aerosol source 22 by ultrasonic waves or the like. The elements that can be used for the first load 21 are not limited to a heater and an ultrasonic element, and various elements or combinations thereof can be used as long as the elements can atomize the aerosol source 22 by consuming the power supplied from the power supply 12.

At least the following matters are described in the present specification. The corresponding components and the like in the above-described embodiment are shown in parentheses, but the present invention is not limited thereto.

(1) A power supply unit (power supply unit 10) for an aerosol generation device, the power supply unit comprising:

a power supply (power supply 12);

a first connector (discharging terminal 41) electrically connectable to an atomizer (first load 21) capable of atomizing an aerosol source (aerosol source 22) and electrically connected to the power supply;

a second connector (connector CN) connectable to a heater (second load 31) capable of heating a flavor source (flavor source 33) that adds a flavor to an aerosol generated from the aerosol source, and electrically connected to the power supply; and a processing device (processor of MCU50) configured to acquire a temperature of the flavor source or the heater, wherein the processing device is configured to start second discharge, which is discharge from the power supply to the heater to make the temperature of the flavor source or the heater converge to a target temperature, before starting first discharge, which is discharge from the power supply to the atomizer, acquire an elapsed time (elapsed time $t_{interval}$) between a start time point of current second discharge and an end time point of a later one of previous first discharge and previous second discharge, and increase power (atomization power $P_{liquid}$) in the first discharge more and/or decrease the target temperature more as the elapsed time becomes longer.

According to (1), when a filter through which the aerosol to which the flavor is added passes is provided in the aerosol generation device, the power in the first discharge is increased and/or the target temperature is decreased as the elapsed time having a correlation with an amount of a flavor component transferred from the flavor source to the filter becomes longer. Since a generation amount of the aerosol is increased by increasing the power in the first discharge, an increase in a density of the flavor of the generated aerosol is prevented. By decreasing the target temperature, an amount of the flavor component added to the generated aerosol decreases, and therefore, the increase in the density of the flavor of the generated aerosol is prevented. As a result, even if inhaling is performed after a long leaving period, a flavor the same as before can be obtained.

(2) The power supply unit according to (1), wherein the processing device is configured to increase the power in the first discharge more and/or decrease the target temperature more as the elapsed time becomes longer.

According to (2), the discharge is controlled such that a density of the flavor in the generated aerosol does not increase. Therefore, even when a flavor the same as that of the related art cannot be provided only by controlling the atomizer or the heater, the flavor can be provided.

(3) The power supply unit according to (1), wherein the processing device is configured to calculate first power that is power supplied to the atomizer, the first power being increased based on the elapsed time, and when the first power exceeds predetermined power (power threshold value $P_{max}$) smaller than maximum power (upper limit power $P_{upper}$) dischargeable from the power supply to the atomizer, only decrease the target temperature among increasing the power in the first discharge and decreasing the target temperature.

According to (3), when it is difficult to increase the power supplied to the atomizer, the target temperature is decreased. Therefore, even when it is difficult to increase the power supplied to the atomizer, a flavor the same as before can be obtained.

(4) The power supply unit according to (1), wherein the processing device is configured to calculate first power that is power supplied to the atomizer, the first power being increased based on the elapsed time, and a first target temperature that is the target temperature decreased based on the elapsed time, and when the first power is equal to or smaller than predetermined power (power threshold value $P_{max}$) smaller than maximum power (upper limit power $P_{upper}$) dischargeable from the power supply to the atomizer, and the first target temperature is lower than a temperature ($T_{cap_sense}$) of the heater, only increase the power in the first discharge among increasing the power in the first discharge and decreasing the target temperature.

According to (4), the power supplied to the atomizer is increased when the power supplied to the atomizer has a reserve capacity, and the target temperature to be decreased in order to realize a stable flavor is lower than the temperature of the heater. In this way, in a state where the temperature of the heater is less likely to decrease to the target temperature, by adjusting the power supplied to the atomizer having high responsiveness, a flavor the same as before can be obtained.

(5) The power supply unit according to (1), wherein the processing device is configured to calculate first power that is power supplied to the atomizer, the first power being increased based on the elapsed time, and a first target temperature that is the target temperature decreased based on the elapsed time, and when the first power is equal to or smaller than predetermined power (power threshold value $P_{max}$) smaller than maximum power (upper limit power $P_{upper}$) dischargeable from the power supply to the atomizer, and the first target temperature is equal to or higher than a temperature ($T_{cap_sense}$) of the heater, only decrease the target temperature among increasing the power in the first discharge and decreasing the target temperature.

According to (5), the target temperature is decreased when the power supplied to the atomizer has a reserve capacity, and the target temperature to be decreased in order to realize a stable flavor exceeds the temperature of the heater. In this way, when the target temperature is decreased, the power supplied to the heater, which is less efficient than the atomizer that directly heats the aerosol source, is reduced, and utilization efficiency of the power supply can be improved.

(6) The power supply unit according to any one of (3) to (5), wherein the processing device is configured to when the temperature of the heater during the first discharge is equal to or higher than the target temperature, discharge the first power (atomization power $P_{liquid}$ or increased $P_{liquid}$) from the power supply to the atomizer, and when the temperature ($T_{cap_sense}$) of the heater during the first discharge is lower than the target temperature, discharge, from the power supply to the atomizer, power obtained by adding a positive value (increase amount $\Delta P$) to the first power, the positive value being equal to or smaller than a value obtained by subtracting the predetermined power from the maximum power.

According to (6), in a case where the temperature of the heater is lower than the target temperature when the power is supplied to the atomizer, the power supplied to the atomizer is increased, whereby the flavor can be stabilized. Therefore, the flavor can be stabilized even in various ways of use.

(7) The power supply unit according to any one of (1) to (6), further comprising:

a command unit (operation unit 14) configured to command the processing device to activate the power supply unit, wherein the processing device is configured to perform one of increasing the power in the first discharge and decreasing the target temperature based on the elapsed time only when the aerosol to which the flavor is added by the flavor source is generated for a first time after the power supply unit is activated.

According to (7), only after the aerosol generation device is activated, at least one of increasing the power supplied to the atomizer and decreasing the target temperature is performed. Therefore, the flavor can be kept unchanged between a case where the flavor component is transferred to the filter and a case where the flavor component is not transferred to the filter. In addition, control performed by the processing device can be simplified.

(8) The power supply unit according to any one of (1) to (7), further comprising:

the command unit (operation unit 14) configured to command the processing device to activate the power supply unit, wherein the processing device is configured to perform one of increasing the power in the first discharge and decreasing the target temperature based on the elapsed time only when the aerosol is generated for the first time after the power supply unit is activated and when a length of inhaling in first aerosol generation after the power supply unit is activated is shorter than a threshold value (lower limit time) and next aerosol generation is performed.

According to (8), when the flavor component transferred to the filter cannot be completely entrained by the aerosol, at least one of increasing the power supplied to the atomizer and decreasing the target temperature is performed in next inhaling. Therefore, even in various ways of use, the flavor can be kept unchanged between the case where the flavor component is transferred to the filter and the case where the flavor component is not transferred to the filter.

(9) The power supply unit according to (7) or (8), wherein the processing device is configured to acquire a remaining amount of the flavor source, and perform one of increasing the power in the first discharge and decreasing the target temperature based on the elapsed time and the remaining amount of the flavor source after the end time point and before the start time point.

According to (9), in consideration of not only an amount of the flavor component transferred to the filter but also the remaining amount of the flavor source, at least one of increasing the power supplied to the atomizer and decreasing the target temperature is performed. Therefore, the flavor can be further stabilized.

(10) An aerosol generation device comprising:

a power supply (power supply 12);

an atomizer (first load 21) capable of atomizing an aerosol source (aerosol source 22);

a flavor source unit (second cartridge 30) including a flavor source (flavor source 33) that adds a flavor component to an aerosol generated from the aerosol source, and a filter (filter 34) provided downstream of the flavor source in a flow of the aerosol;

a heater (second load 31) capable of heating the flavor source; and a processing device (processor of MCU 50), wherein the processing device is configured to start second discharge, which is discharge from the power supply to the heater to make a temperature of the flavor source or the heater converge to a target temperature, before starting first discharge, which is discharge from the power supply to the atomizer, estimate an amount of the flavor component adsorbed to the filter, and increase power in the first discharge and/or decrease the target temperature as the estimated amount of the flavor component adsorbed to the filter increases.

According to (10), as the amount of the flavor component transferred from the flavor source to the filter increases, the power in the first discharge is increased and/or the target temperature is decreased. Since a generation amount of the aerosol is increased by increasing the power in the first discharge, an increase in a density of the flavor of the generated aerosol is prevented. By decreasing the target temperature, an amount of the flavor component added to the generated aerosol decreases, and therefore, the increase in the density of the flavor of the generated aerosol is prevented. As a result, even if inhaling is performed after a long leaving period, a flavor the same as before can be obtained.

(11) An aerosol generation device comprising:

a power supply (power supply 12);

an atomizer (first load 21) capable of atomizing an aerosol source (aerosol source 22);

a flavor source unit (second cartridge 30) including a flavor source (flavor source 33) that adds a flavor component to an aerosol generated from the aerosol source, and a filter (filter 34) provided downstream of the flavor source in a flow of the aerosol; and a processing device (processor of MCU 50), wherein the processing device is configured to estimate an amount of the flavor component adsorbed to the filter, and increase power discharged to the atomizer for aerosol generation as the estimated amount of the flavor component adsorbed to the filter increases.

According to (11), as the amount of the flavor component transferred from the flavor source to the filter increases, the power discharged to the atomizer is increased. Thereby, since a generation amount of the aerosol is increased, an increase in a density of the flavor of the generated aerosol is prevented. As a result, even if inhaling is performed after a long leaving period, a flavor the same as before can be obtained.

What is claimed is:

1. A power supply unit for an aerosol generation device, the power supply unit comprising:

a power supply;

a first connector electrically connectable to an atomizer capable of atomizing an aerosol source and electrically connected to the power supply;

a second connector connectable to a heater capable of heating a flavor source that adds a flavor to an aerosol generated from the aerosol source, and electrically connected to the power supply; and a processing device configured to acquire a temperature of the flavor source or the heater, wherein the processing device is configured to start second discharge, which is discharge from the power supply to the heater to make the temperature of the flavor source or the heater converge to a target temperature, before starting first discharge, which is discharge from the power supply to the atomizer, acquire an elapsed time between a start time point of current second discharge and an end time point of a later one of previous first discharge and previous second discharge, and increase power in the first discharge more and/or decrease the target temperature more as the elapsed time becomes longer.

2. The power supply unit according to claim 1, wherein the processing device is configured to increase the power in the first discharge more and/or decrease the target temperature more as the elapsed time becomes longer.

3. The power supply unit according to claim 1, wherein the processing device is configured to calculate first power that is power supplied to the atomizer, the first power being increased based on the elapsed time, and when the first power exceeds predetermined power smaller than maximum power dischargeable from the power supply to the atomizer, only decrease the target temperature among increasing the power in the first discharge and decreasing the target temperature.

4. The power supply unit according to claim 1, wherein the processing device is configured to calculate first power that is power supplied to the atomizer, the first power being increased based on the elapsed time, and a first target temperature that is the target temperature decreased based on the elapsed time, and when the first power is equal to or smaller than predetermined power smaller than maximum power dischargeable from the power supply to the atomizer, and the first target temperature is lower than a temperature of the heater, only increase the power in the first discharge among increasing the power in the first discharge and decreasing the target temperature.

5. The power supply unit according to claim 1, wherein the processing device is configured to calculate first power that is power supplied to the atomizer, the first power being increased based on the elapsed time, and a first target temperature that is the target temperature decreased based on the elapsed time, and when the first power is equal to or smaller than predetermined power smaller than maximum power dischargeable from the power supply to the atomizer, and the first target temperature is equal to or higher than a temperature of the heater, only decrease the target temperature among increasing the power in the first discharge and decreasing the target temperature.

6. The power supply unit according to claim 3, wherein the processing device is configured to when the temperature of the heater during the first discharge is equal to or higher than the target temperature, discharge the first power from the power supply to the atomizer, and when the temperature of the heater during the first discharge is lower than the target temperature, discharge, from the power supply to the atomizer, power obtained by adding a positive value to the first power, the positive value being equal to or smaller than a value obtained by subtracting the predetermined power from the maximum power.

7. The power supply unit according to claim 1, further comprising:

a command unit configured to command the processing device to activate the power supply unit, wherein the processing device is configured to perform one of increasing the power in the first discharge and decreasing the target temperature based on the elapsed time only when the aerosol to which the flavor is added by the flavor source is generated for a first time after the power supply unit is activated.

8. The power supply unit according to claim 1, wherein a command unit configured to command the processing device to activate the power supply unit, wherein the processing device is configured to perform one of increasing the power in the first discharge and decreasing the target temperature based on the elapsed time only when the aerosol is generated for the first time after the power supply unit is activated and when a length of inhaling in first aerosol generation after the power supply unit is activated is shorter than a threshold value and next aerosol generation is performed.

9. The power supply unit according to claim 7, wherein the processing device is configured to acquire a remaining amount of the flavor source, and perform one of increasing the power in the first discharge and decreasing the target temperature based on the elapsed time and the remaining amount of the flavor source after the end time point and before the start time point.

10. An aerosol generation device comprising:

a power supply;

an atomizer capable of atomizing an aerosol source;

a flavor source unit including a flavor source that adds a flavor component to an aerosol generated from the aerosol source, and a filter provided downstream of the flavor source in a flow of the aerosol;

a heater capable of heating the flavor source; and a processing device, wherein the processing device is configured to start second discharge, which is discharge from the power supply to the heater to make a temperature of the flavor source or the heater converge to a target temperature, before starting first discharge, which is discharge from the power supply to the atomizer, estimate an amount of the flavor component adsorbed to the filter, and increase power in the first discharge and/or decrease the target temperature as the estimated amount of the flavor component adsorbed to the filter increases.

* * * * *